US009351544B2

(12) United States Patent
Matsumori

(10) Patent No.: US 9,351,544 B2
(45) Date of Patent: May 31, 2016

(54) ACCESSORY COUPLING STRUCTURE

(71) Applicant: JEWEL KOBE Company Limited, Nishinomiya-shi, Hyogo (JP)

(72) Inventor: Masafumi Matsumori, Nishinomiya (JP)

(73) Assignee: JEWEL KOBE Company Limited, Nishinomiya-shi, Hyogo (JP)

( * ) Notice: Subject to any disclaimer, the term of this patent is extended or adjusted under 35 U.S.C. 154(b) by 0 days.

(21) Appl. No.: 14/370,467

(22) PCT Filed: Dec. 26, 2012

(86) PCT No.: PCT/JP2012/008299

§ 371 (c)(1),
(2) Date: Jul. 2, 2014

(87) PCT Pub. No.: WO2013/102983

PCT Pub. Date: Jul. 11, 2013

(65) Prior Publication Data

US 2014/0373321 A1 Dec. 25, 2014

(30) Foreign Application Priority Data

Jan. 5, 2012 (JP) ..... 2012-000528

(51) Int. Cl.
*A44C 25/00* (2006.01)
*A44C 5/20* (2006.01)

(52) U.S. Cl.
CPC ..... *A44C 5/2061* (2013.01); *A44C 25/00* (2013.01); *Y10T 24/45545* (2015.01)

(58) Field of Classification Search
CPC ..... A44C 25/00; A44C 5/2061; Y10S 24/60; Y10T 24/3904; Y10T 24/45016; Y10T 24/45545
USPC ..... 24/574.1, 587.11, 595.1, 618, 663
See application file for complete search history.

(56) References Cited

U.S. PATENT DOCUMENTS 3,286,316 A 11/1966 Marosy
4,216,567 A 8/1980 Heinz
(Continued)

FOREIGN PATENT DOCUMENTS

JP 2003-225107 A 8/2003
JP 2005-152350 A 6/2005

OTHER PUBLICATIONS

International Search Report for PCT/JP2012/008299, mailed Mar. 19, 2013.

*Primary Examiner* — Robert J Sandy
*Assistant Examiner* — David Upchurch
(74) *Attorney, Agent, or Firm* — Marshall, Gerstein & Borun LLP

(57) ABSTRACT

A coupling structure includes: a rod-shaped rod attached to a first end of an accessory; and a receiving portion attached to a second end of the accessory and an insertion hole portion, which receives the rod, and an accommodating portion. The receiving portion includes: a cylindrical slider into which at least a tip end portion of the rod is inserted and which is slidable and rotatable in the insertion hole and the accommodating portion; a guide groove configured to restrict the movement of the slider to switch the position of the slider to a first position or a second position; and a locking pin that inhibits the movement of the rod in the receiving portion in a pull-out direction when the slider is located at the first position and that allows the rod to move when the slider is located at the second position.

9 Claims, 25 Drawing Sheets

(56) References Cited

U.S. PATENT DOCUMENTS 4,246,679 A * 1/1981 Monett ..... 24/587.11
5,138,855 A * 8/1992 Faris ..... 70/457
6,883,211 B2 * 4/2005 Hoshino ..... 24/663
8,578,573 B2 * 11/2013 Hashimoto ..... 24/595.1
2005/0188512 A1 * 9/2005 Ninomiya ..... 24/587.11
2009/0276989 A1 * 11/2009 Mongkhonpradit ..... 24/595.1

* cited by examiner (b-b LINE)

(c-c LINE)

ACCESSORY COUPLING STRUCTURE

TECHNICAL FIELD

The present invention relates to a coupling structure of an accessory, such as a necklace or a bracelet.

BACKGROUND ART

An accessory, such as a necklace, a bracelet, or an anklet, which is worn in a circular state includes a pair of coupling members that are respectively provided at a first end portion and second end portion of the accessory, in order that the first end portion and the second end portion are coupled to each other. To be specific, when wearing the accessory around a neck, an aim, or the like, the coupling member provided at the first end portion of the accessory and the coupling member provided at the second end portion of the accessory are coupled to each other, so that the accessory forms a circular shape.

For example, in the case of the necklace, the necklace is worn by coupling the coupling members at the back of (at the rear side of) the neck, that is, at a position that is out of sight. Normally, these coupling members are extremely small. Therefore, when coupling both end portions of the necklace to each other, a wearer has to do detailed work.

To reduce complexity of the work done when wearing the necklace, the following coupling structure has been proposed. To be specific, proposed is a coupling structure configured such that: an inserting portion that is the coupling member formed at the first end portion of the necklace is inserted into an insertion hole portion that is the coupling member formed at the second end portion of the necklace; the inserting portion is rotated to be positioned; and in this positioned state, the inserting portion is further inserted into the insertion hole portion to be coupled to the insertion hole portion (see PTLs 1 and 2, for example).

CITATION LIST

Patent Literature

PTL 1: Japanese Examined Patent Application Publication No. 41-945

PTL 2: Japanese Laid-Open Patent Application Publication No. 52-574

SUMMARY OF INVENTION

Technical Problem

However, the coupling structure of the conventional accessory requires two types of positioning that are the positioning for inserting the inserting portion into the insertion hole portion and the positioning performed when rotating the inserting portion relative to the insertion hole portion. To be specific, in a case where the wearer couples the first end portion and second end portion of the necklace or the like at a position that is out of sight (such as the rear side of the neck), he or she has to gropingly perform the above-described two types of positioning. Therefore, the work done when wearing the accessory, such as the necklace, is still troublesome.

The present invention was made under these circumstances, and an object of the present invention is to provide an accessory coupling structure by which end portions of an accessory can be easily coupled to each other.

Solution to Problem

To solve the above problem, an accessory coupling structure according to the present invention includes: a rod-shaped inserting portion attached to a first end of an accessory; and a receiving portion attached to a second end of the accessory and including an insertion hole that receives the inserting portion, wherein the receiving portion includes: a cylindrical slider into which at least a tip end portion of the inserting portion is inserted and which is slidable and rotatable in the insertion hole; a guide unit configured to restrict a movement of the slider in the insertion hole so as to switch a position of the slider to a first position or a second position; and a coupling unit configured to, when the slider is located at the first position, inhibit a movement of the inserting portion in the receiving portion in a pull-out direction, and when the slider is located at the second position, allow the inserting portion to move in an insertion direction and the pull-out direction in the receiving portion.

According to the above configuration, the receiving portion includes the slider and the guide unit. Therefore, only by inserting the inserting portion into the receiving portion, the position of the slider can be switched to the first position or the second position by the movement (sliding and rotation) of the slider restricted by the guide unit.

Since the receiving portion includes the coupling unit, the movement of the inserting portion in the pull-out direction can be inhibited and the movement of the inserting portion in the receiving portion in the insertion direction and the pull-out direction can be allowed in accordance with the position (the first position or the second position) of the slider.

As above, only by inserting the inserting portion into the receiving portion, the movement of the inserting portion in the pull-out direction can be inhibited, and the movement of the inserting portion in the receiving portion in the insertion direction and the pull-out direction can be allowed.

Therefore, the accessory coupling structure according to the present invention has an effect of being able to more easily couple the end portions of the accessory to each other.

Advantageous Effects of Invention

As is clear from the above explanation, the present invention has the effect of being able to easily couple the end portions of the accessory to each other.

DESCRIPTION OF EMBODIMENTS

Embodiment 1

Hereinafter, a coupling structure (accessory coupling structure) 100 according to Embodiment 1 of the present invention will be specifically explained in reference to the drawings. Embodiment 1 will be explained using as an example an accessory, such as a necklace, which is worn in a circular state.

Figure 1:
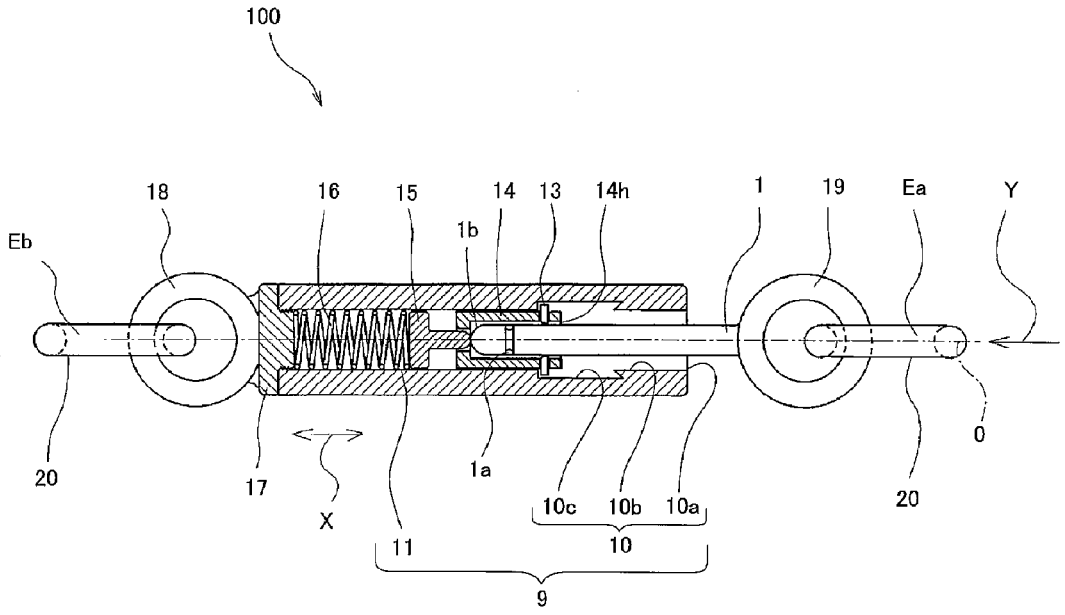
FIG. 1 is a cross-sectional view showing one example of the configuration of an entire coupling structure according to Embodiment 1.

As shown in FIG. 1, the accessory coupling structure 100 according to Embodiment 1 is configured such that a first end Ea and second end Eb of a single chain can be coupled to each other by a pair of coupling members. A rod (inserting portion) 1 as the coupling member is connected to the first end Ea of the chain. A receiving portion 9 as the coupling member is connected to the second end Eb of the chain. The receiving portion 9 includes an insertion hole portion 10. As above, the coupling structure 100 is constituted by the rod 1 and the receiving portion 9 that form a pair.

First, the shape of the rod 1 will be explained. The rod 1 is a rod-like member having a circular cross section. A ring-shaped locking groove (engagement portion) la is formed on an outer peripheral surface of a portion of the rod 1 so as to extend along a circumferential direction in the cross section of the rod 1, the portion being located in the vicinity of a pointed end of the rod 1. A bottom of the locking groove 1*a* (see FIG. 2) is processed so as to be depressed in a curved shape such that the locking groove 1*a* can smoothly engage with a columnar locking pin (coupling unit) 13 in a below-described slider 14.

A rod head 1*b* that is the pointed end of the rod 1 has a semispherical shape so as to allow the rod 1 to be smoothly inserted into the receiving portion 9. Especially, the rod head 1*b* is "chamfered" so as to have a curvature radius substantially the same as a curvature radius of the cross section of the rod 1. However, the shape of the rod head 1*b* is not limited to such a semispherical shape. The rod head 1*b* may have any shape as long as by inserting the rod head 1*b* into the insertion hole portion 10 of the receiving portion 9, the rod head 1*b* can push the locking pin 13, accommodated in the insertion hole portion 10 and projecting in the slider 14, to an outside of the slider 14. For example, the shape of the rod head 1*b* may be a shape obtained by just chamfering an edge of the pointed end portion of the rod 1 having the columnar shape.

A coupling ring 19 to which the first end Ea of a chain 20 of the necklace is coupled is formed at a base end-side end portion of the rod 1.

Next, the structure of the receiving portion 9 will be explained. Regarding the receiving portion 9, a side through which the rod 1 is inserted is referred to as an insertion side (tip end side), and an opposite side is referred to as a bottom side (base end side). The receiving portion 9 is a cylindrical member and includes the insertion hole portion 10 and an accommodating portion 11 as holes (insertion holes) into which the rod 1 is inserted. The insertion hole portion 10 and the accommodating portion 11 communicate with each other such that the rod 1 can be inserted along a central axis O of the receiving portion 9 having the cylindrical shape.

The insertion hole portion 10 is a portion that receives the rod 1. As shown in FIG. 1, an insertion-side opening 10*a* that receives the rod 1 is formed at the insertion side of the receiving portion 9. Further, in the insertion hole portion 10, an insertion passage 10*b* having a circular cross section extends from the insertion-side opening 10*a* toward the bottom side.

An inner diameter of the insertion-side opening 10*a* is larger than an outer diameter of the rod 1 such that the rod 1 can move in a radial direction. Specifically, the insertion-side opening 10*a* has the inner diameter that is about twice the outer diameter of the rod 1. A guide groove (guide unit) 10*c* is further formed at the bottom side of the insertion passage 10*b* extending from the insertion-side opening 10*a*. The guide groove 10*c* is a groove that defines the movement of the below-described locking pin (coupling unit) 13. Sawtooth-shaped concave-convex portions are respectively formed on inner peripheral surfaces of an insertion-side end portion and bottom-side end portion of the guide groove 10*c* (see FIG. 3 described below). The diameter of a portion of the guide groove 10*c* is larger than that of the insertion passage 10*b*, the portion being sandwiched between these concave-convex portions.

In the receiving portion 9, the below-described slider 14 and the locking pin 13 included in the slider 14 move in accordance with forward and backward movements of the rod 1 in an insertion direction (X direction in FIG. 1) of the rod 1. To be specific, when the locking pin 13 contacts the concave-convex portion of the guide groove 10*c*, it moves in the circumferential direction of the insertion hole portion 10 by a certain distance. Then, by the movement of the locking pin 13, the slider 14 rotates in the circumferential direction of the insertion hole portion 10.

Figure 3:
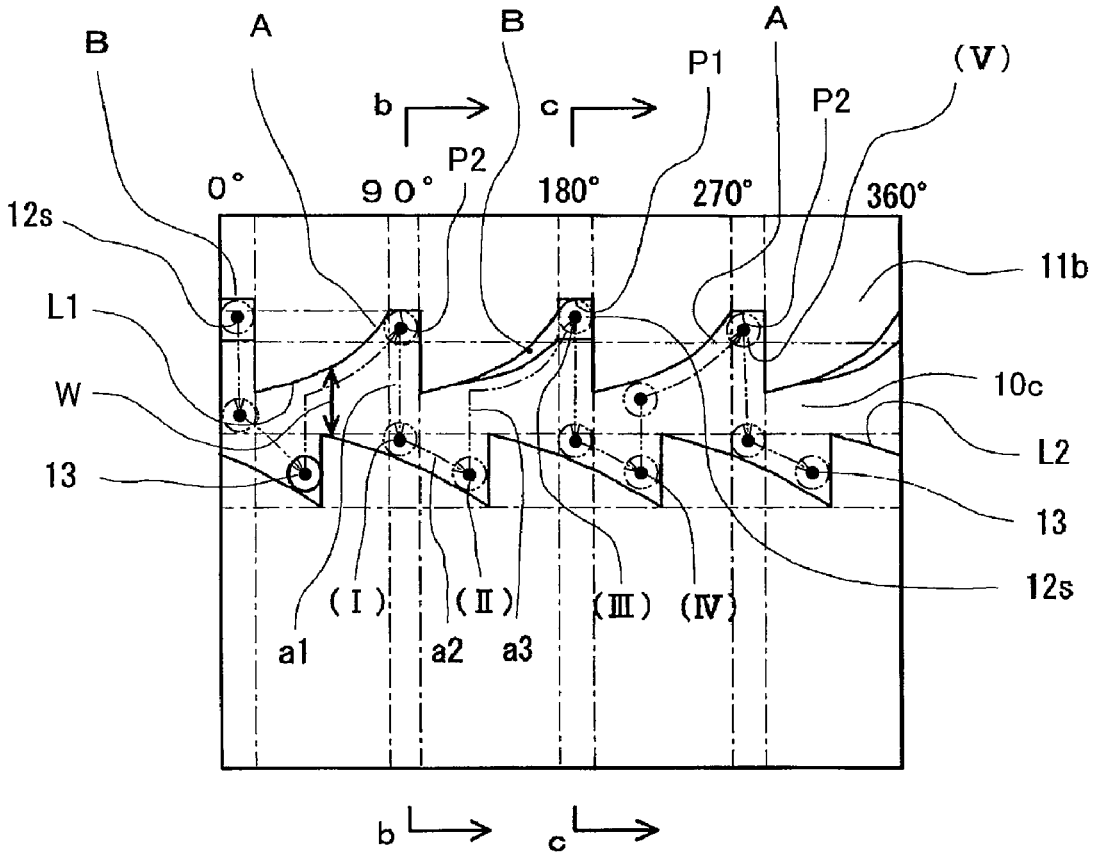
FIG. 3 is a developed view of the receiving portion and shows one example of a guide groove formed on an inner peripheral surface of the receiving portion in the coupling structure shown in FIG. 1.

Specifically, as the guide groove 10*c*, grooves having shapes shown in FIG. 3 are formed on the inner peripheral surface of the insertion hole portion 10. FIG. 3 is a diagram showing one example of a state where the inner peripheral surface of the insertion hole portion 10 according to Embodiment 1 is developed in a plane. Hereinafter, details of the guide groove 10*c* will be explained in reference to FIG. 3.

Here, a width of the guide groove 10*c* in the insertion direction of the rod 1 is referred to as a groove width W. The groove width W of the guide groove 10*c* is larger than the diameter of the cross section of the locking pin 13 having the columnar shape. Specifically, the groove width W is about twice to five times the diameter of the cross section of the locking pin 13. The locking pin 13 is configured to move in a space whose width in the insertion direction of the rod 1 is the groove width W. As above, the space where the locking pin 13 can move is formed in the guide groove 10*c*. Therefore, when the necklace is in a coupled state, a backlash in the insertion direction (direction Y in FIG. 1) of the rod 1 is formed at a coupled portion of the coupling structure 100. Therefore, even if external force for causing the rod 1 to move in the insertion direction is unintentionally applied to the rod 1, the coupled state between the rod 1 and the receiving portion 9 can be maintained.

As described above, the sawtooth-shaped concave-convex portions are respectively formed at the insertion-side end portion (line L1 in FIG. 3) and bottom-side end portion (line L2 in FIG. 3) of the guide groove 10*c*. More specifically, as shown in FIG. 3, a convex portion of the line L2 is arranged at a position shifted from a convex portion of the line L1 in the circumferential direction of the guide groove 10*c* by substantially 45°.

Here, concave-convex shapes of the lines L1 and L2 (concave-convex shapes of the lines L1 and L2 when the inner peripheral surface of the guide groove 10*c* is viewed from a hole center side) will be explained more specifically. The shape of the concave-convex portion that forms the line L2 is formed such that convex portions each having a substantially triangular shape are repeatedly formed at a fixed cycle, the substantially triangular shape being formed to: extend upward and substantially straight from the bottom side to the insertion side by a predetermined distance; and be then gently inclined from a peak of the upward extension to the bottom side.

The concave-convex portion that forms the line L1 is configured such that two types of convex shapes A and B explained below are alternately formed in the circumferential direction of the guide groove 10*c*. To be specific, as shown in FIG. 3, the line L1 is formed such that each of the two types of convex shapes A and B has a substantially triangular shape formed to: extend upward and straight from the insertion side to the bottom side; and be then gently inclined from a peak position of the upward extension to the insertion side. To be specific, the concave-convex portion of the line L1 includes the convex portions projecting in a direction opposite to the convex portions of the line L2. The bottom of a concave portion formed between the convex portions of the line L1 is flat by a predetermined interval. The predetermined interval is formed between the convex portion of the convex shape A and the convex portion of the convex shape B, which are adjacent to each other.

Regarding the line L1, the above-described convex shapes A and B are basically, substantially the same in shape as each other, but the positions of the concave portions each formed between the convex shapes A and B are different from each other. The position of the bottom of the concave portion formed between the gentle inclination of the convex shape A and the portion, extending upward and straight toward the bottom side, of the convex shape B is denoted by P2. The position of the bottom of the concave portion formed between the gentle inclination of the convex shape B and the portion, extending upward and straight toward the bottom side, of the convex shape A is denoted by P1. In Embodiment 1, the position P1 is located closer to the insertion side than the position P2. To be specific, the receiving portion 9 is configured such that the positions P1 and P2 are different from each other.

The coupling structure 100 according to Embodiment 1 can switch between the coupled state and the cancellation of the coupled state depending on whether the position of the locking pin 13 contacting the line L1 (concave-convex portion) formed at the insertion-side end portion of the guide groove 10*c* is the position P1 or P2. Each of the positions P1 and P2 of the line L1 of the guide groove 10*c* corresponds to the concave portion of the guide groove of the present invention.

Figure 4:
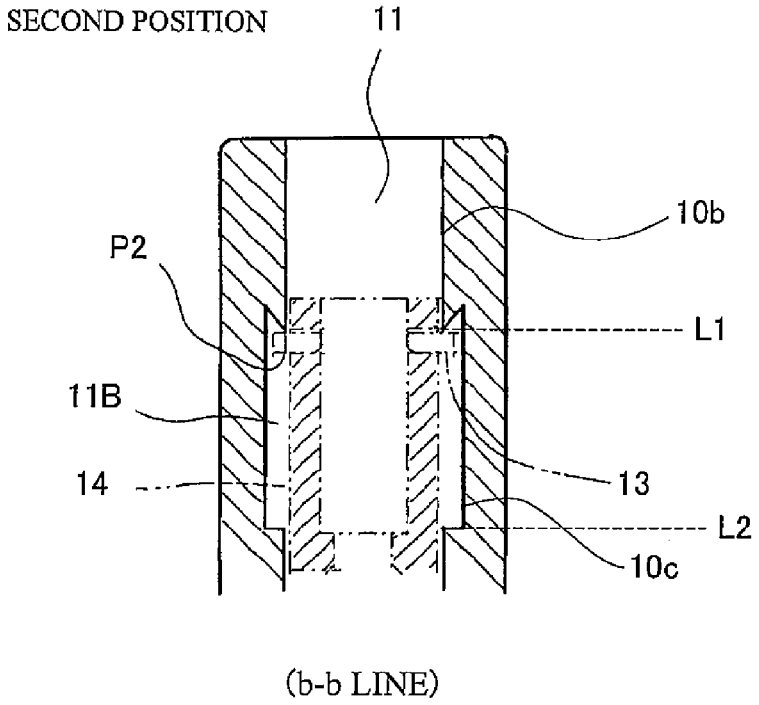
FIG. 4 shows one example of the shape of a cross section of the receiving portion, the cross section being taken along a line connecting two opposing locking pins located at a b-b base point in the coupling structure shown in FIG. 3.

FIG. 4 shows the cross-sectional shape of the guide groove 10*c* when the locking pin 13 is located at the position P2. This cross-sectional shape is a cross-sectional shape taken along line b-b of FIG. 3 in the insertion direction of the rod 1 at a position between two locking pins 13. As shown in FIG. 3, the cross-sectional shape of the line L1 located at a boundary between the insertion passage 10*b* and the guide groove 10*c* is a shape obtained by cutting out triangles each of whose apex is the insertion-side end portion of the guide groove 10*c* (see FIG. 4). In other words, the cross section of a bottom-side end portion of the insertion passage 10*b* has substantially triangular shapes projecting toward the guide groove 10*c*.

As described above, Embodiment 1 is configured such that the coupling between the rod 1 and the receiving portion 9 is canceled when the slider 14 is located at such a position that the locking pin 13 is located at the position P2 of the line L1. The position of the slider 14 when the coupling between the rod 1 and the receiving portion 9 is canceled is referred to as a second position.

Figure 5:
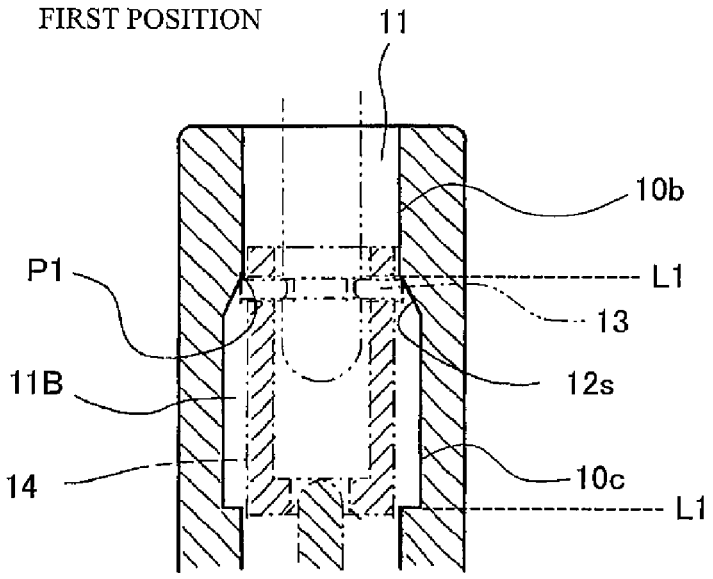
FIG. 5 shows one example of the shape of a cross section of the receiving portion, the cross section being taken along a line connecting two opposing locking pins located at a c-c base point in the coupling structure shown in FIG. 3.

FIG. 5 shows the cross-sectional shape of the guide groove 10*c* when the locking pin 13 is located at the position P1 of the line L1. This cross-sectional shape is a cross-sectional shape taken along line c-c of FIG. 3 in the insertion direction of the rod 1 at a position between two locking pins 13.

To be specific, the cross-sectional shape of the line L1 located at the boundary between the insertion passage 10*b* and the guide groove 10*c* is a tapered shape that tapers toward the insertion passage 10*b* (a sandwiching portion 12*s* in FIG. 5). In Embodiment 1, the coupled state between the rod 1 and the receiving portion 9 is realized when the slider 14 is located at such a position that the locking pin 13 is located at the position P1 of the line L1. The position of the slider 14 when the coupled state between the rod 1 and the receiving portion 9 is realized is referred to as a first position.

As above, the cross-sectional shape of the portion of the line L1 differs depending on whether the locking pin 13 is located at the position P2 or P1. By utilizing this difference of the cross-sectional shape, the coupling between the rod 1 and the receiving portion 9 in the coupling structure 100 according to Embodiment 1 is realized or canceled. Details will be described later.

Next, the accommodating portion 11 formed at the bottom side of the guide groove 10*c* in the receiving portion 9 will be explained. The accommodating portion 11 accommodates a below-described pressing pin 15, a pressing spring (stretching member) 16, and the slider 14 and has a cylindrical shape extending from the guide groove 10*c* toward the bottom side of the receiving portion 9 and having a circular cross section.

A bottom-side end portion of the accommodating portion 11 is closed in such a manner that a bottom portion 17 is threadedly engaged with a bottom-side end portion of the receiving portion 9 (see FIG. 1). However, the present embodiment is not limited to this configuration. For example, without providing the bottom portion 17, the accommodating portion 11 itself may be formed in a bottomed hole whose bottom-side end portion is closed.

As shown in FIG. 1, a coupling ring 18 to which the second end Eb of the chain 20 of the necklace is coupled is formed on a bottom-side surface (outside surface) of the bottom portion 17 so as to be integrated with the bottom portion 17.

As shown in FIG. 1, the accommodating portion 11 accommodates: the pressing spring 16 provided so as to contact the bottom portion 17; the pressing pin 15 adjacent to the pressing spring 16 at the insertion side of the pressing spring 16; and the slider 14 adjacent to the pressing pin 15 at the insertion side of the pressing pin 15.

Figure 2:
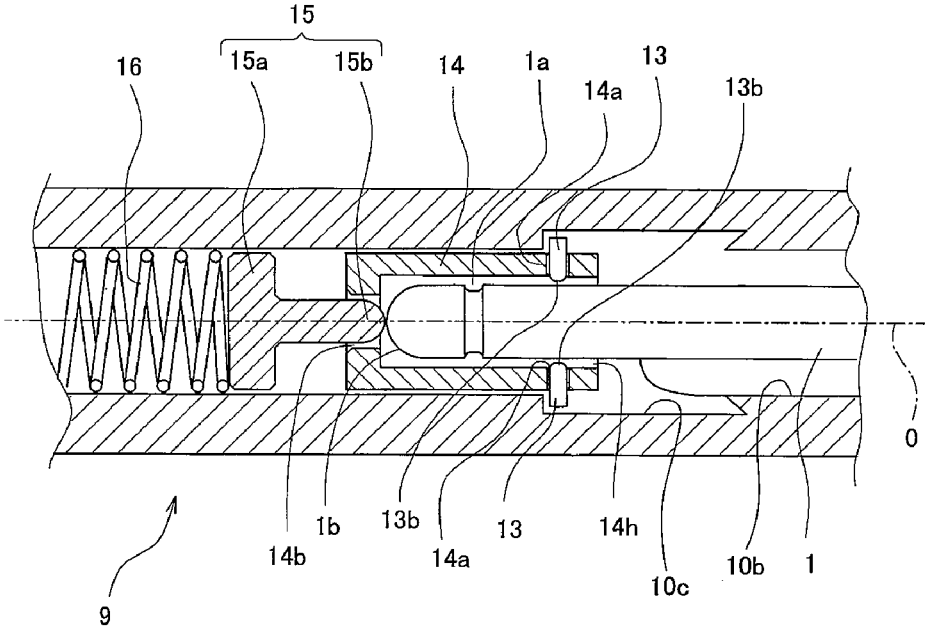
FIG. 2 is an enlarged cross-sectional view showing a state where a rod is accommodated in a slider of a receiving portion in the coupling structure shown in FIG. 1.

The pressing spring 16 presses the pressing pin 15 toward the insertion side (tip end side) of the receiving portion 9. As shown in FIGS. 1 and 2, the pressing pin 15 is constituted by: a columnar base portion 15*a* contacting the pressing spring 16; and a rod-like member 15*b* projecting from the base portion 15*a* toward the insertion side of the receiving portion 9.

A tip end of the rod-like member 15*b* of the pressing pin 15 contacts the pointed end of the inserted rod 1, and the pressing pin 15 presses the rod 1 from the bottom side (base end side) of the receiving portion 9 toward the insertion side (tip end side). Therefore, when the rod 1 is not inserted into the receiving portion 9, the slider 14 is pressed from the bottom side of the receiving portion 9 toward the insertion side by the pressing pin 15 biased by the pressing spring 16.

The below-described slider 14 is configured to move forward and backward in the insertion direction of the rod 1 while rotating. Therefore, the force of the pressing spring 16 that presses the slider 14 via the pressing pin 15 acts such that the pressing spring 16 extends forward and contracts backward along the insertion direction of the rod 1, and in addition, the pressing spring 16 is being twisted in a direction around a rotation axis of the slider 14. When the pressing spring 16 returns to an original state from this twisted state, the pressing spring 16 generates force in a direction opposite to the rotational direction of the slider 14. Therefore, to prevent the slider 14 from being influenced by the twist of the pressing spring 16, the pressing pin 15 is provided between the pressing spring 16 and the slider 14.

The slider 14 includes: a bottom surface located at the bottom side of the receiving portion 9; and an insertion hole 14*h* that is located at the insertion side of the receiving portion 9 and is an opening that receives the rod 1 (see FIGS. 1 and 2). The slider 14 can slide in the accommodating portion 11 to move forward and backward in the insertion direction of the rod 1. In addition, the slider 14 can rotate about the central axis O as a rotational center at a position between the accommodating portion 11 and the guide groove 10*c*. A through hole 14*b* (see FIG. 2) that receives the rod-like member 15*b* of the pressing pin 15 is formed at the center of the bottom surface of the slider 14.

Two locking pin insertion holes 14*a* are formed on a side portion of the slider 14 at regular intervals, the side portion being located in the vicinity of the insertion hole 14*h* (see FIG. 2). By respectively inserting the locking pins 13 through the locking pin insertion holes 14*a*, each of the locking pins 13 can move in a direction substantially perpendicular to an extending direction of the slider 14 and toward the central axis O of the receiving portion 9 and can move so as to project from the side portion of the slider 14 toward an outside of the slider 14.

The locking pins 13 engage with the locking groove 1*a* of the rod 1. With this, the forward and backward movements of the rod 1 in the insertion direction are inhibited. In addition, the locking pins 13 respectively contact the concave-convex portions of the lines L1 and L2 of the guide groove 10*c*. With this, the slider 14 is caused to rotate in the circumferential direction at the inner periphery of the receiving portion 9. An inner peripheral edge 13*b* of the locking pin 13 is chamfered so as to be able to smoothly engage with the locking groove 1*a* of the rod 1 (see FIG. 2). The inner peripheral edge 13*b* of the locking pin 13 is an end portion projecting toward the inner peripheral side of the slider 14.

In Embodiment 1, as described above, two locking pins 13 are provided at an outer periphery of the slider 14 at regular intervals. However, the number of locking pins 13 is not limited to two. For example, the number of locking pins 13 may be three or three or more. In a case where a plurality of locking pins 13 are arranged, the force acting on the rod 1 from the locking pins 13 can be distributed by a plurality of locking pins 13 to act on the rod 1.

Since equal force from a plurality of locking pins 13 acts on the rod 1, the rod 1 can be locked stably. Needless to say, in a case where a plurality of locking pins 13 are arranged, the locking pin insertion holes 14*a* are formed in accordance with the number of locking pins 13.

According to the coupling structure 100 of Embodiment 1, the wearer can easily couple and decouple the coupling structure 100 even at a position that is out of sight. To be specific, when the rod 1 is inserted into the receiving portion 9, the coupling structure 100 operates as below, and the coupling members can be easily coupled to each other. Further, the coupling members that have been coupled to each other can be easily decoupled from each other.

Hereinafter, coupling and decoupling operations by the coupling structure 100 will be explained in reference to FIGS. 6 to 9 in addition to FIGS. 1 to 5 described above. FIGS. 6 to 9 are diagrams each showing one example of the coupled state between the rod 1 and the receiving portion 9 in the coupling structure 100 according to Embodiment 1.

Figure 6:
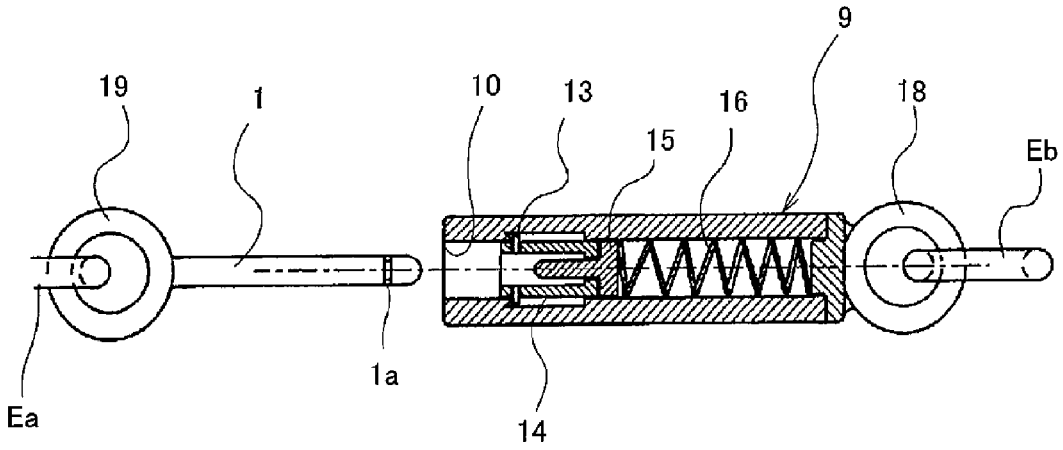
FIG. 6 is a diagram showing one example of a coupled state between the rod and the receiving portion in the coupling structure according to Embodiment 1.
Figure 7:
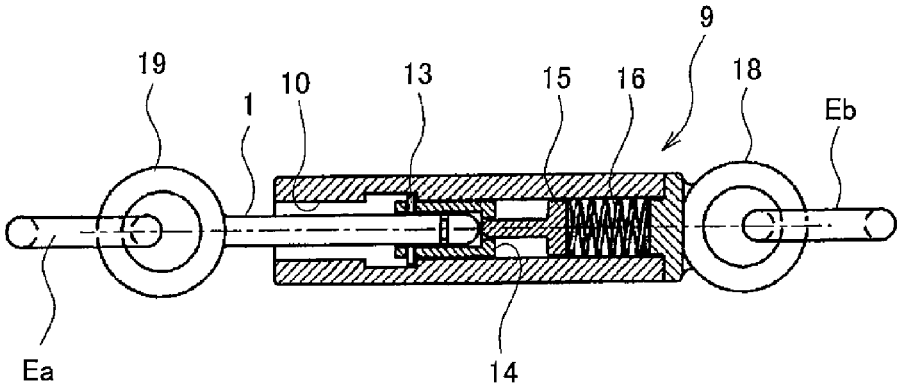
FIG. 7 is a diagram showing one example of the coupled state between the rod and the receiving portion in the coupling structure according to Embodiment 1.
Figure 8:
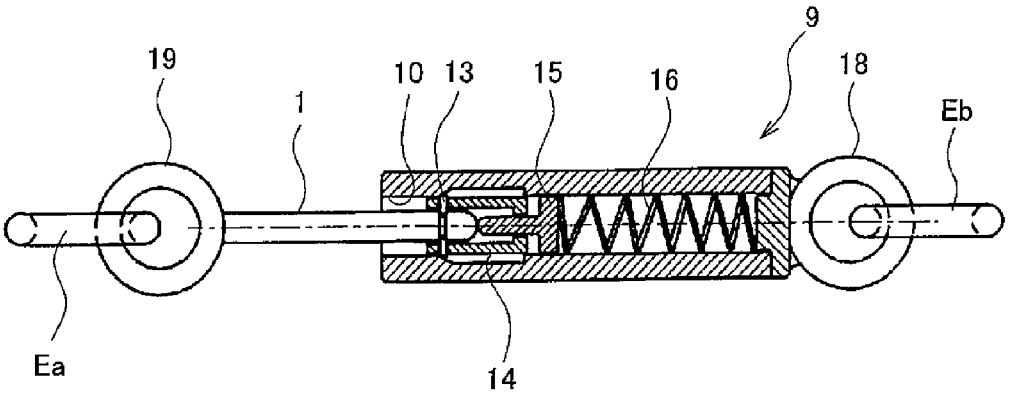
FIG. 8 is a diagram showing one example of the coupled state between the rod and the receiving portion in the coupling structure according to Embodiment 1.

In a state where the rod 1 and the receiving portion 9 are separated from each other as shown in FIG. 6, first, the pointed end of the rod 1 is inserted into the insertion hole portion 10 (insertion-side opening 10*a*) of the receiving portion 9. When the rod 1 is inserted into the receiving portion 9, the locking pins 13 inserted in the side portion of the slider 14 are pushed by the rod 1 to the outside of the slider 14 as shown in FIG. 7.

When the rod 1 is further inserted toward the bottom side of the receiving portion 9, the rod 1 contacts the slider 14 and the pressing pin 15. When the rod 1 is further inserted, the slider 14 and the pressing pin 15 are pushed by the rod 1 toward the bottom side of the receiving portion 9. Then, the locking pin 13 attached to the side portion of the slider 14 moves by a distance a1 as shown in FIG. 3 to contact the concave-convex portion formed as the line L2 of the guide groove 10*c* (position (I) in FIG. 3). At this time, the rod 1 is inserted against the pressing force of the pressing spring 16 that presses the slider 14 and the pressing pin 15.

When the rod 1 is further inserted, the locking pin 13 moves along the inclination of the concave-convex portion of the line L2 by a certain distance (distance a2) in the circumferential direction of the line L2 and then contacts the portion, extending upward and straight toward the insertion side, of the line L2 to stop at this position (position (II) in FIG. 3). By the movement of the locking pin 13 so far, the slider 14 has rotated substantially 45° from an initial position to be located at this position (see FIG. 7).

Here, when the force applied to the rod 1 for inserting the rod 1 into the receiving portion 9 is released, the rod 1 is pushed toward the insertion side of the receiving portion 9 by the rod-like member 15*b* of the pressing pin 15 pressed by the restoring force of the pressing spring 16. Next, the base portion 15*a* of the pressing pin 15 contacts the slider 14, and the slider 14 is pushed toward the insertion side of the receiving portion 9. When the slider 14 is pushed out toward the insertion side as above, the locking pin 13 contacts the line L1 and moves by a distance a3 along the gentle arc inclination of the convex portion (convex shape B) of the line L1 to be located at the position P1 of the line L1 (position (III) in FIG. 3). By the movement of the locking pin 13, the slider 14 has further rotated about 45° from the state shown in FIG. 7 to become the state shown in FIG. 8.

When the locking pin 13 is located at the position P1, the position of the slider 14 of the coupling structure 100 is the first position shown in FIG. 5. When the position of the slider 14 is the first position, the locking pin 13 is pushed toward the inside of the slider 14 by a tapered end portion of the guide groove 10*c*, that is, the sandwiching portion 12*s*. As above, when the position of the slider 14 is the first position, the end portions of the locking pins 13 are inserted into the locking groove 1*a* of the rod 1. Therefore, the rod 1 is sandwiched between the inserted pins 13 inserted as shown in FIG. 5, so that the rod 1 cannot be taken out from the receiving portion 9. With this, both ends Ea and Eb of the necklace are coupled to each other by the coupling structure 100, and this coupled state is maintained.

Even if the force in the direction X shown in FIG. 1 acts on the coupling structure 100 when the coupling members (the rod 1 and the receiving portion 9) are in the coupled state, the rod 1 does not come out (is not decoupled) from the insertion hole portion 10. Even if the pressing force in the direction Y accidentally acts on the rod 1 such that the rod 1 is inserted, the rod 1 is just pressed up to a predetermined depth, and the coupled state is not canceled as long as, for example, the locking pin 13 moves from the position (III) to the position (IV) in FIG. 3. This is because as described above, a space where the locking pin 13 can move to some extent is formed in the guide groove 10*c*.

When canceling the coupled state between the coupling members in the coupling structure 100, the rod 1 is pushed such that the locking pin 13 moves to a position (position (IV) in FIG. 3) where the locking pin 13 contacts the line L2 of the guide groove 10*c* and cannot move any more. To be specific, the rod 1 is pressed toward the receiving portion 9 again to cause the locking pins 13 of the slider 14 to move. As the rod 1 is inserted, the locking pin 13 moves toward the bottom side of the receiving portion 9 to contact the line L2. Then, the locking pin 13 moves in the circumferential direction of the line L2 along the inclination of the line L2 and stops in front of the upwardly extending portion of the line L2 (position (IV) in FIG. 3). At this time, the slider 14 further rotates 45° to become the state shown in FIG. 7.

When the force acting on the rod 1 for inserting the rod 1 into the receiving portion 9 is released in this state, the rod 1 is pushed toward the insertion side by the pressing pin 15 pressed by the pressing spring 16, and then, the slider 14 is also pushed toward the insertion side. With this, the locking pin 13 contacts the line L1 and moves along the gentle arc inclination of the convex portion (convex shape A) of the line L1 to reach the position P2 of the line L1 (position (V) in FIG. 3). By the movement of the locking pin 13, the slider 14 further rotates about 45°.

Figure 9:
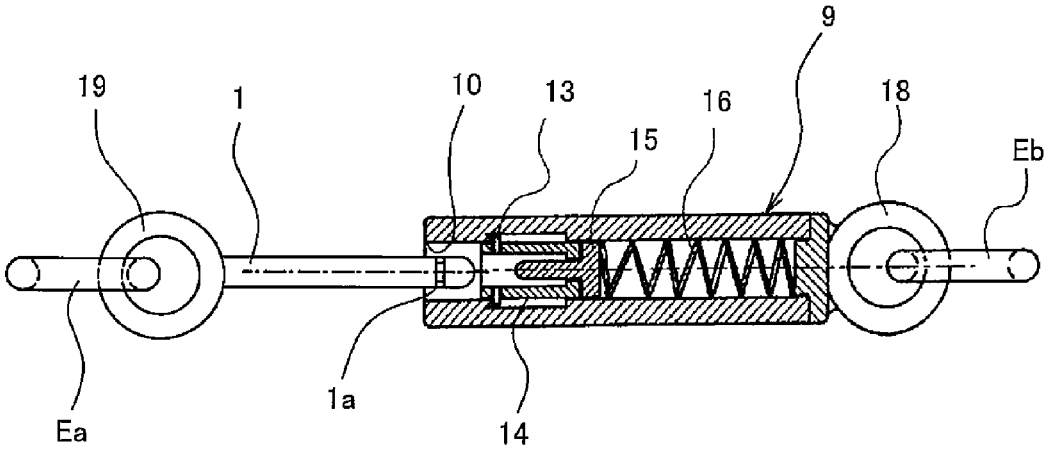
FIG. 9 is a diagram showing one example of the coupled state between the rod and the receiving portion in the coupling structure according to Embodiment 1.

A relation between the receiving portion 9 and the rod 1 at this time becomes, as shown in FIG. 9 for example, a state where the locking pins 13 move outward from the side portion of the slider 14 to be separated from the locking groove 1*a*. More specifically, the locking pins 13 at this time are located at the second position shown in FIG. 4, and the locking pins 13 are pushed out to the outside of the slider 14 by the rod 1. Then, a pushed-out portion of each locking pin 13 contacts a substantially triangular protruding portion protruding from the insertion passage 10*b* into the guide groove 10*c*.

As above, the movement of the slider 14 pressed from the bottom side toward the insertion side is stopped in a state where the locking pin 13 contact the protruding portion as shown in FIG. 4. The protruding portion is formed in a triangular shape having an acute angle toward the bottom side and prevents the locking pin 13 from moving into the slider 14. Then, only the rod 1 can be easily pulled out from the receiving portion 9. To be specific, the coupling structure 100 according to Embodiment 1 is configured such that the coupled state between the rod 1 and the receiving portion 9 is canceled when the locking pins 13 are located at the second position in the receiving portion 9.

Figure 10:
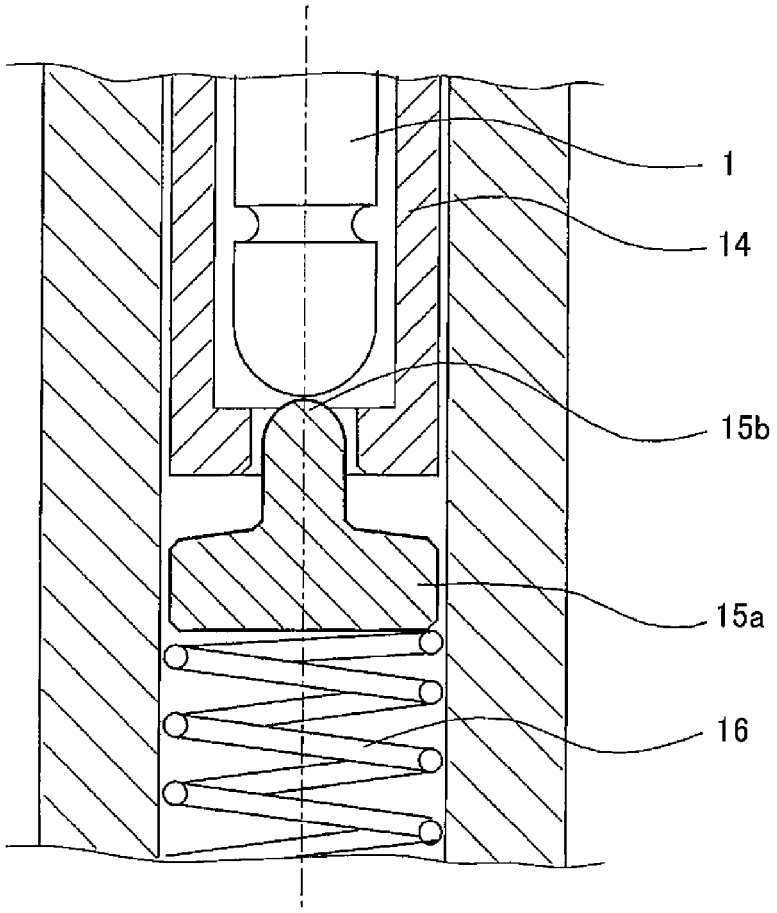
FIG. 10 is a cross-sectional view showing one example of the configuration of a pressing pin according to Embodiment 1.

As shown in FIGS. 1 and 2 for example, the pressing pin 15 included in the receiving portion 9 according to Embodiment 1 has such a shape that the long and thin rod-like member 15*b* projects from the columnar base portion 15*a*. However, the shape of the pressing pin 15 is not limited to this. For example, as shown in FIG. 10, an end surface, on which the rod-like member 15*b* is formed, of the base portion 15*a* may have a tapered shape projecting toward the rod-like member 15*b*. With this, when the pressing pin 15 presses the slider 14 toward the insertion side by the restoring force of the pressing spring 16, the pressing pin 15 contacts the slider 14 at a middle portion of a bottom portion of the slider 14. Therefore, the pressing force can be uniformly applied to all the locking pins 13 arranged at the side portion of the slider 14 so as to cause the locking pins 13 to contact the end portion (line L1) of the guide groove 10*c*.

In the receiving portion 9 according to Embodiment 1, the cross-sectional shape of the guide groove 10*c* at the position P2 of the line L1 is a triangular shape projecting from the insertion passage 10*b* side to the guide groove 10*c* side and having an acute-angled apex. Since the cross-sectional shape of the line L1 has such an edge shape, the locking pin 13 is prevented from moving into the slider 14. However, for example, by forming the shape of the locking pin 13 as below, the locking pin 13 may be prevented from moving into the slider 14.

Figure 11:
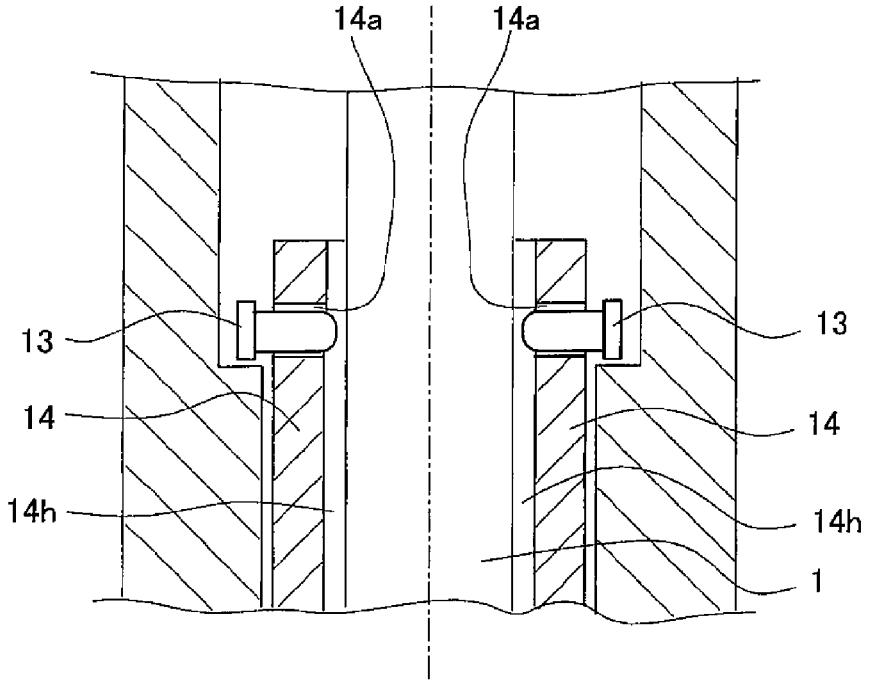
FIG. 11 is a cross-sectional view showing one example of the configuration of the locking pins and locking pin insertion holes according to Embodiment 1.

To be specific, as shown in FIG. 11, the cross section of an end portion (outer peripheral end) of the locking pin 13 may be larger than the diameter of the locking pin insertion hole 14*a*, the end portion being located outside the slider 14. With this, even in a case where the locking pin 13 moves toward the inside of the slider 14, the outer peripheral end of the locking pin 13 contacts the outside surface of the slider 14, so that the locking pin 13 is prevented from getting into the slider 14. FIG. 11 shows a state where the rod 1 is inserted into the insertion hole 14*h* of the slider 14, and the locking pins 13 are pushed to the outside of the slider 14.

Figure 12:
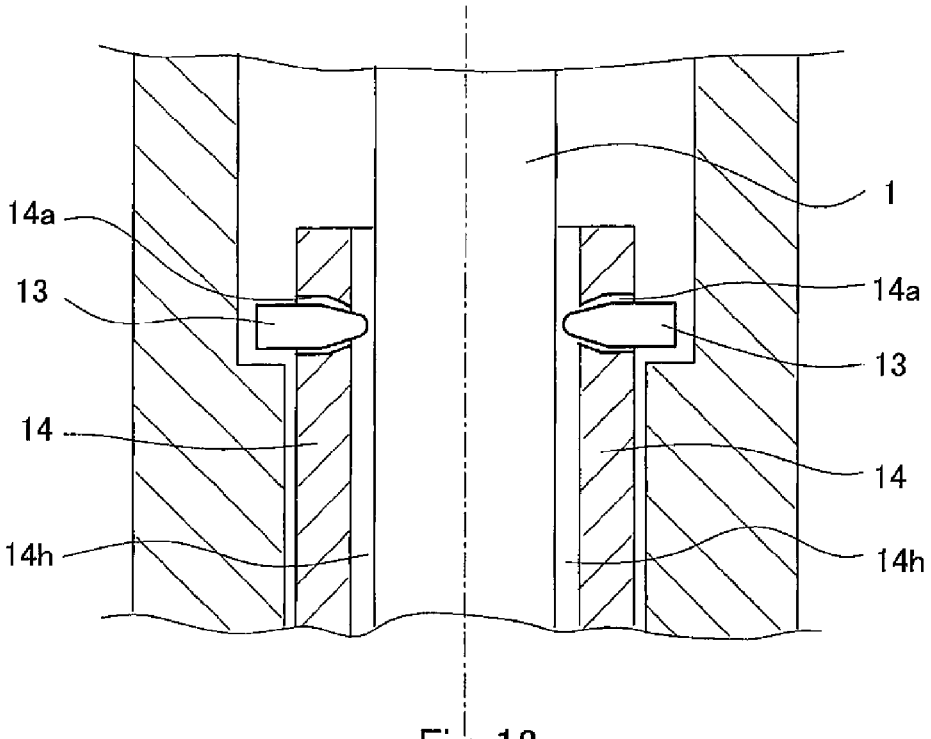
FIG. 12 is a cross-sectional view showing one example of the configuration of the locking pins and the locking pin insertion holes according to Embodiment 1.

As shown in FIG. 12, the shape of the locking pin 13 may be such that an end portion (inner peripheral edge) of the locking pin 13 tapers, the end portion being arranged in the slider 14. Further, as shown in FIG. 12, the diameter of the locking pin insertion hole 14*a* formed on the side portion of the slider 14 may decrease from the outer periphery to inner periphery of the slider 14. A smallest diameter of the locking pin insertion hole 14*a* is set so as to be larger than the cross section of the inner peripheral end of the locking pin 13 and smaller than the cross section of the outer peripheral end of the locking pin 13. With this, even in a case where the locking pin 13 moves toward the inside of the slider 14, the locking pin 13 can be prevented from getting into the slider 14. FIG. 12 shows a state where the rod 1 is inserted into the insertion hole 14*h* of the slider 14, and the locking pins 13 are pushed to the outside of the slider 14.

The coupling structure 100 according to Embodiment 1 is configured such that: the concave-convex portion of the line L1 and the concave-convex portion of the line L2 are respectively formed at the insertion side and bottom side of the guide groove 10*c*; and the concave-convex portion of the line L1 and the concave-convex portion of the line L2 are arranged so as to be opposed to each other. Each of the line L1 and the line L2 is formed entirely in the circumferential direction of the guide groove 10*c*.

When the locking pin 13 is located at the position P1 of the line L1, the position of the slider 14 is the first position. When the locking pin 13 is located at the position P2, the position of the slider 14 is the second position. However, the shapes of the lines L1 and L2 of the guide groove 10*c* are not limited to the above-described shapes. Further, the configuration for switching the position of the slider 14 to the first position or the second position is not limited to this.

Hereinafter, Modification Examples of the configuration for switching the position of the slider 14 to the first position or the second position will be explained.

Modification Example 1

Figure 13:
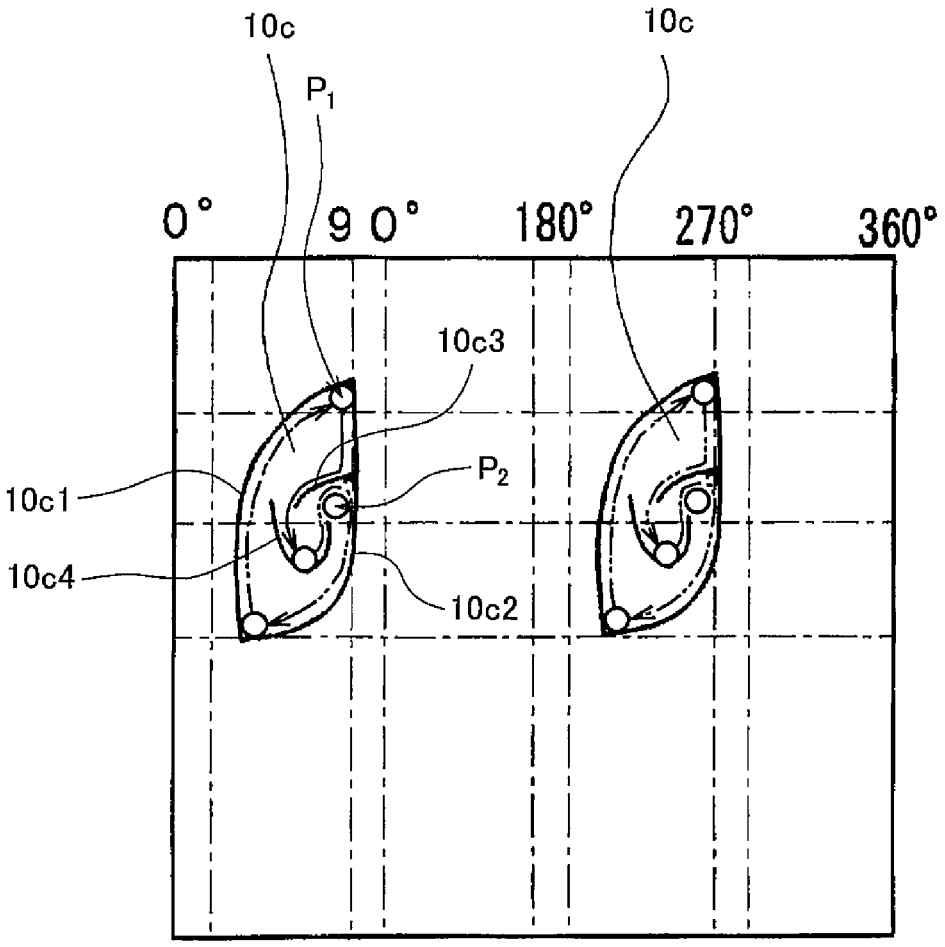
FIG. 13 is a developed view of the receiving portion and shows one example of the guide groove formed on an inner peripheral surface of an insertion hole of the receiving portion in the coupling structure according to Modification Example 1 of Embodiment 1.

The coupling structure 100 according to Modification Example 1 is the same in configuration as the above-described coupling structure 100 except for the shape of the guide groove 10*c* described below. To be specific, as shown in FIG. 13, oval grooves as the guide grooves 10*c* may be respectively formed in a region whose center angle is from substantially 0° to 90° and a region whose center angle is from substantially 180° to 270° on the inner periphery of the receiving portion 9. Modification Example 1 explains a case where the number of locking pins 13 included in the slider 14 in the coupling structure 100 is two. The movement of one of the locking pins 13 is restricted by the guide groove 10*c* formed in the region of substantially 0° to 90°, and the movement of the other locking pin 13 is restricted by the guide groove 10*c* formed in the region of substantially 180° to 270°. Therefore, the guide groove 10*c* formed in the region of substantially 0° to 90° and the guide groove 10*c* formed in the region of substantially 180° to 270° are the same in shape as each other.

In each of the guide grooves 10*c* shown in FIG. 13, a left half of the oval groove is referred to as a left outer groove 10*c*1, and a right half of the oval groove is referred to as a right outer groove 10*c*2. An insertion-side step 10*c*3 arranged at the insertion side (tip end side) and a bottom-side step 10*c*4 arranged at the bottom side (base end side) are formed in a region surrounded by the left outer groove 10*c*1 and right outer groove 10*c*2 of the guide groove 10*c*.

The grooves of the guide groove 10*c* shown in FIG. 13 are formed such that: when the rotational position of the slider 14 is the position of about 0° (180°), the slider 14 is located at the most insertion side (tip end side); and when the rotational position of the slider 14 is the position of about 90° (270°), the slider 14 is located at the most bottom side (base end side).

When the rod 1 is inserted into the receiving portion 9, the locking pin 13 moves straight toward the bottom side from the position P1 that is the most insertion side in the guide groove 10*c*, and then, the locking pin 13 contacts the insertion-side step 10*c*3 having an arc shape that is shown by a curved line depressed substantially toward the insertion side.

The locking pin 13 that has contacted the insertion-side step 10*c*3 moves along an insertion-side surface of the insertion-side step 10*c*3. When the locking pin 13 moves beyond an end portion of the insertion-side step 10*c*3, it further moves toward the bottom side. Then, the locking pin 13 contacts the bottom-side step 10*c*4 having a U shape shown by a curved line depressed substantially toward the bottom side. By pushing force that acts from the insertion side toward the bottom side by the insertion of the rod 1, the locking pin 13 is pressed against a depressed portion of the bottom-side step 10*c*4. Thus, the movement of the locking pin 13 stops.

When the force acting on the rod 1 for inserting the rod 1 into the receiving portion 9 is released, the pressing pin 15 presses the rod 1 and the slider 14 toward the insertion side of the receiving portion 9 by the restoring force of the pressing spring 16. With this, the locking pin 13 moves in an arc toward the insertion side along the bottom-side step 10*c*4.

The locking pin 13 that has moved toward the insertion side of the guide groove 10*c* contacts a bottom-side surface of the insertion-side step 10*c*3. By pressing force toward the insertion side, the locking pin 13 is pressed against a depressed portion of tip end-side step 10*c*3. Thus, the movement of the locking pin 13 stops (position P2 in FIG. 14).

When the force for inserting the rod 1 into the receiving portion 9 is again applied to the rod 1, the locking pin 13 moves from the insertion-side step 10*c*3 toward the bottom side along the right outer groove 10*c*2. By the pushing force that acts from the insertion side toward the bottom side by the insertion of the rod 1, the locking pin 13 is pressed against the position at the most bottom side of the guide groove 10*c*. Thus, the movement of the locking pin 13 stops.

When the force acting on the rod 1 for inserting the rod 1 into the receiving portion 9 is released in this state, the pressing pin 15 presses the rod 1 and the slider 14 toward the insertion side of the receiving portion 9 by the restoring force of the pressing spring 16. With this, the locking pin 13 moves from the bottom side toward the insertion side along the left outer groove 10*c*1. Then, the locking pin 13 reaches the position (P1) at the most tip end side of the guide groove 10*c*. The locking pin 13 is pressed against the position (P1) by the pressing force acting toward the tip end side. Thus, the movement of the locking pin 13 stops (position P1 in FIG. 13).

As above, by repeating the insertion of the rod 1 into the receiving portion 9 and the release of the force acting on the rod 1 for insertion, the locking pin 13 alternately moves to the two positions P1 and P2.

In Modification Example 1, the position of the slider 14 when the locking pin 13 is located at the position P1 is the first position. In this case, as shown in FIG. 5, the locking pins 13 are pushed into the slider 14 and sandwich the rod 1 in the slider 14 to realize the coupled state. In contrast, the position of the slider 14 when the locking pin 13 is located at the position P2 is the second position. In this case, as shown in FIG. 4, the locking pins 13 are pushed to the outside of the slider 14 by the rod 1, so that the coupled state is canceled.

However, Modification Example 1 of Embodiment 1 is not limited to the above configuration and may be configured such that the position of the slider 14 when the locking pin 13 is located at the position P1 is the second position, and the position of the slider 14 when the locking pin 13 is located at the position P2 is the first position.

The shape of the guide groove 10*c* is not limited to this and may be a shape obtained by flipping the guide groove 10*c* of Modification Example 1 upside down.

Modification Example 2

Next, the configuration of the coupling structure 100 according to Modification Example 2 will be explained in reference to FIG. 14.

Figure 14:
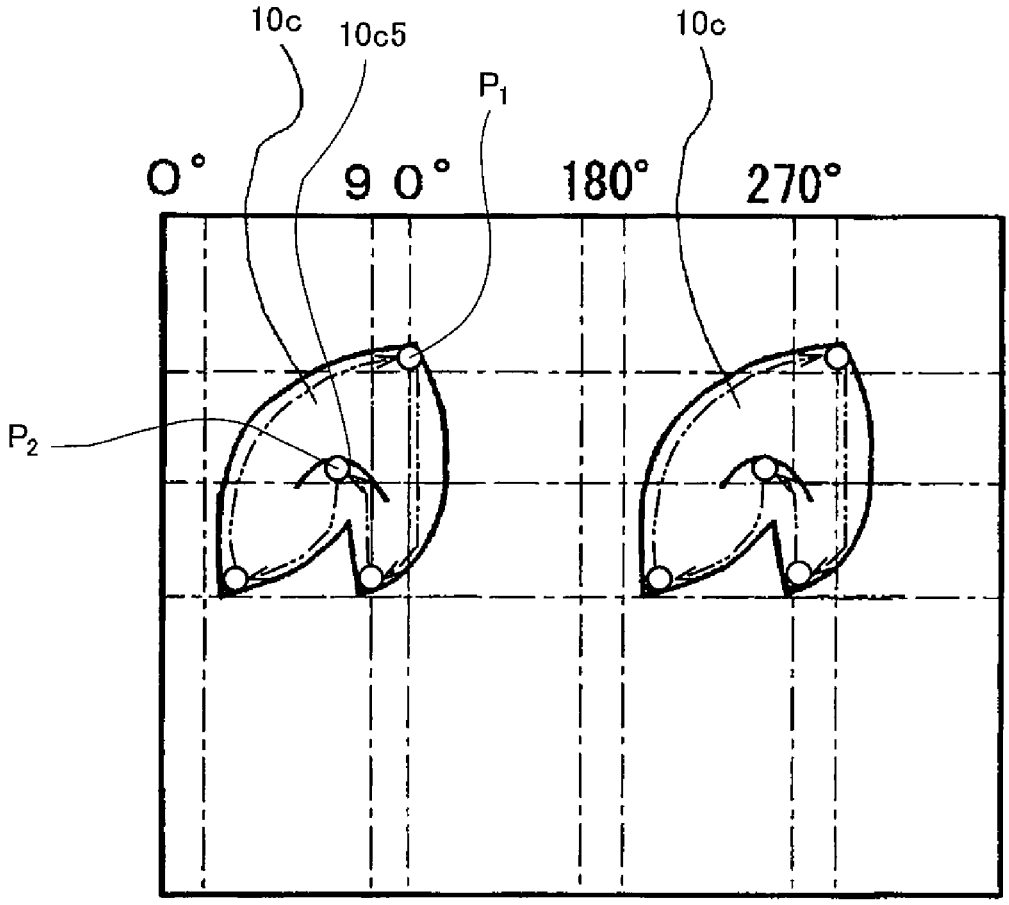
FIG. 14 is a developed view of the receiving portion and shows one example of the guide groove formed on the inner peripheral surface of the insertion hole of the receiving portion in the coupling structure according to Modification Example 2 of Embodiment 1.

As shown in FIG. 14, the coupling structure 100 according to Modification Example 2 may be configured such that grooves each having a shape obtained by flipping a heart shape upside down are respectively formed as the guide grooves 10*c* in the region of 0° to 90° and the region of 180° to 270° in the inner circumferential direction of the receiving portion 9.

Modification Example 2 explains a case where the number of locking pins 13 included in the slider 14 in the coupling structure 100 is two. The movement of one of the locking pins 13 is restricted by the guide groove 10*c* formed in the region of 0° to 90°, and the movement of the other locking pin 13 is restricted by the guide groove 10*c* formed in the region of 180° to 270°. Therefore, the guide groove 10*c* formed in the region of 0° to 90° and the guide groove 10*c* formed in the region of 180° to 270° are the same in shape as each other.

According to the coupling structure 100 of Modification Example 2, when the rod 1 is inserted into the receiving portion 9, the locking pin 13 moves straight toward the bottom side from the position P1 that is the most insertion side in the guide groove 10*c* to reach the depressed portion at the bottom side. Then, by the pushing force that acts from the insertion side toward the bottom side by the insertion of the rod 1, the locking pin 13 is pressed against the depressed portion, and the movement of the locking pin 13 stops.

When the force acting on the rod 1 for inserting the rod 1 into the receiving portion 9 is released, the pressing pin 15 presses the rod 1 and the slider 14 toward the insertion side of the receiving portion 9 by the restoring force of the pressing spring 16. With this, the locking pin 13 contacts a U-shaped intermediate holding step 10*c*5 provided in the vicinity of a substantially center of a heart lateral groove shape and shown by a curved line depressed toward the insertion side. By the pressing force toward the tip end side, the locking pin 13 is pressed against the intermediate holding step 10*c*5. Thus, the movement of the locking pin 13 stops (position P2 in FIG. 14).

When the force for inserting the rod 1 into the receiving portion 9 is again applied to the rod 1, the locking pin 13 moves from the intermediate holding step 10*c*5 toward the base end side. Then, the locking pin 13 moves along the guide groove 10*c* to reach the portion depressed toward the bottom side. By the pressing force that acts from the insertion side toward the bottom side by the insertion of the rod 1, the locking pin 13 is pressed against this depressed portion. Thus, the movement of the locking pin 13 stops.

When the force acting on the rod 1 for inserting the rod 1 into the receiving portion 9 is released, the pressing pin 15 presses the rod 1 and the slider 14 toward the insertion side of the receiving portion 9 by the restoring force of the pressing spring 16. With this, the locking pin 13 moves from the bottom side toward the insertion side along the guide groove 10*c* having the heart lateral groove shape to reach the position P1 of FIG. 14. By the pressing force toward the insertion side, the locking pin 13 is pressed at the position P1. Thus, the movement of the locking pin 13 stops.

As above, by applying the force for inserting the rod 1 and releasing the force, the locking pin 13 alternately moves to the two positions P1 and P2.

In Modification Example 2, the position of the slider 14 when the locking pin 13 is located at the position P1 is the first position. In this case, as shown in FIG. 5, the locking pins 13 are pushed into the slider 14 and sandwich the rod 1 in the slider 14 to realize the coupled state. In contrast, the position of the slider 14 when the locking pin 13 is located at the position P2 is the second position. In this case, as shown in FIG. 4, the locking pin 13 is pushed to the outside of the slider 14 by the rod 1, so that the coupled state is canceled.

Modification Example 2 is configured such that: the position of the slider 14 when the locking pin 13 is located at the position P1 is the first position; and the position of the slider 14 when the locking pin 13 is located at the position P2 is the second position. However, Modification Example 2 may be configured such that: the position of the slider 14 when the locking pin 13 is located at the position P1 is the second position, and the position of the slider 14 when the locking pin 13 is located at the position P2 is the first position.

The shape of the guide groove 10*c* is not limited to this and may be a shape obtained by flipping the shape of the guide groove 10*c* of Modification Example 2 upside down.

Modification Example 3

Figure 15:
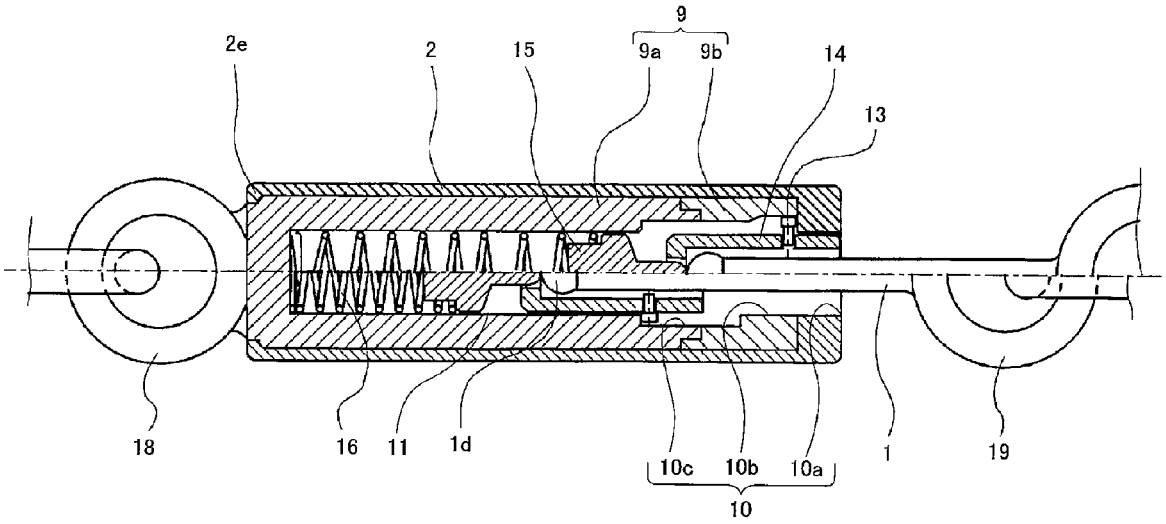
FIG. 15 is a cross-sectional view showing one example of the schematic configuration of a coupling structure 100 according to Modification Example 3 of Embodiment 1.
Figure 16:
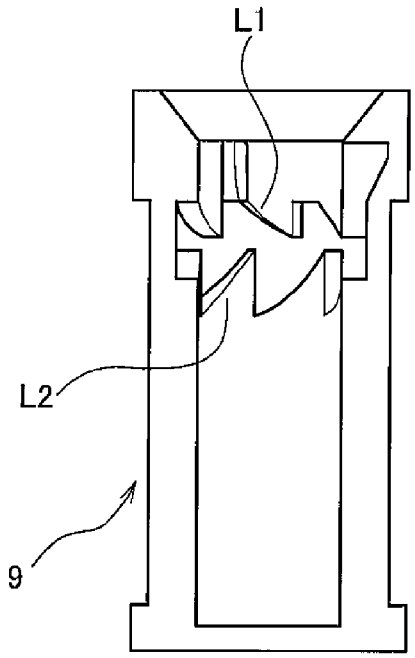
FIG. 16 is a cross-sectional view of the receiving portion having a cylindrical shape, the cross-sectional view being taken along an extending direction of the receiving portion (that is, a direction in which the rod is inserted) in the coupling structure according to Modification Example 3 of Embodiment 1.
Figure 17:
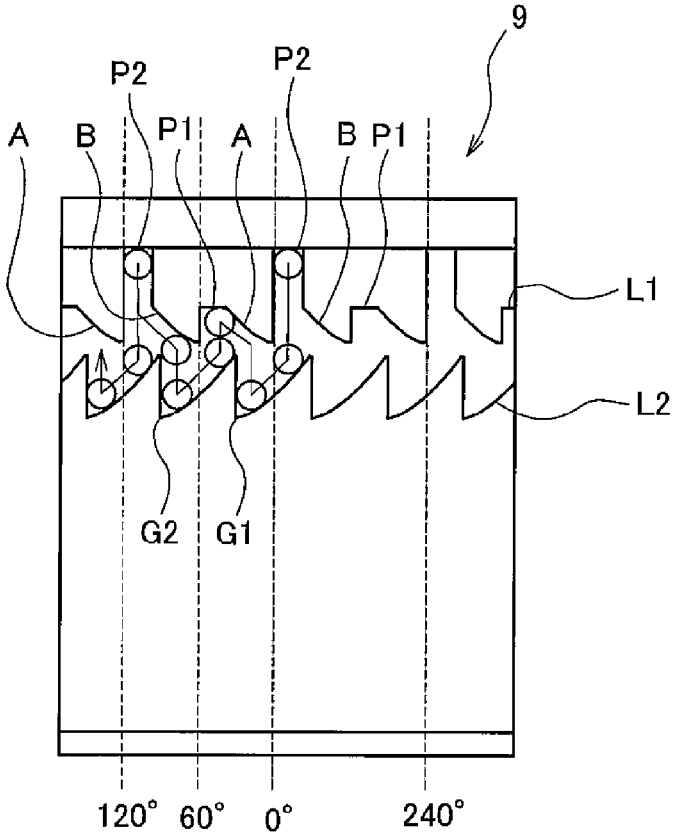
FIG. 17 is a developed view of the receiving portion shown in FIG. 16.
Figure 18:
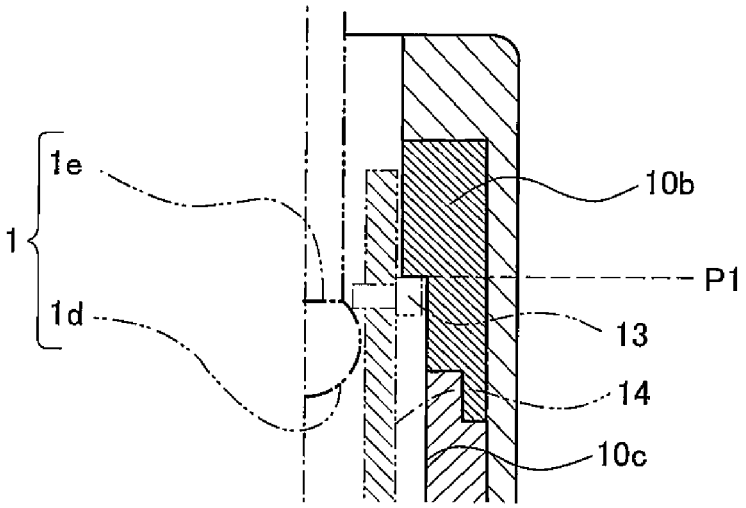
FIG. 18 is a cross-sectional view showing a positional relation among the locking pin, the guide groove, and the rod in the configuration in which the locking pin is located at a position P1 of the guide groove shown in FIG. 17.
Figure 19:
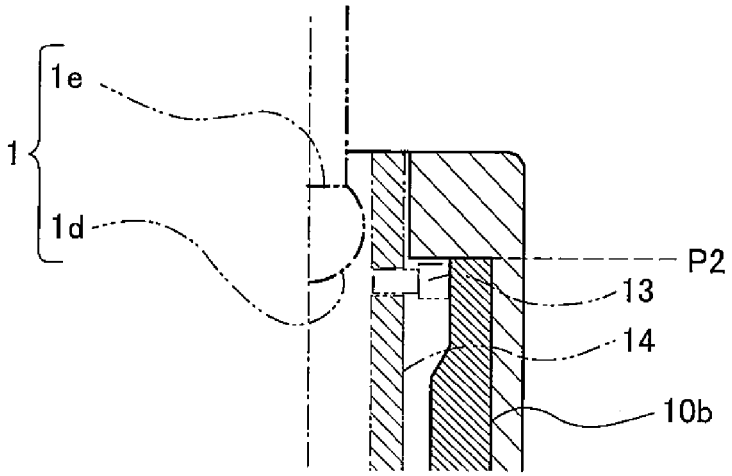
FIG. 19 is a cross-sectional view showing a positional relation among the locking pin, the guide groove, and the rod in the configuration in which the locking pin is located at a position P2 of the guide groove shown in FIG. 17.

Next, the configuration of the coupling structure 100 according to Modification Example 3 will be explained in reference to FIGS. 15 to 19. FIG. 15 is a cross-sectional view showing one example of the schematic configuration of the coupling structure 100 according to Modification Example 3 of Embodiment 1. An upper side in FIG. 15 shows a state where the rod 1 is inserted through the insertion-side opening 10*a* into the insertion passage 10*b* in the receiving portion 9, and a lower side in FIG. 15 shows a state where the rod 1 is inserted to be pushed to the bottom side of the receiving portion 9. FIG. 16 is a cross-sectional view of the receiving portion 9 having a cylindrical shape in the coupling structure 100 according to Modification Example 3 of Embodiment 1, the cross-sectional view being taken along the extending direction (the insertion direction of the rod 1) of the receiving portion 9. FIG. 17 is a developed view of the receiving portion 9 shown in FIG. 16. FIG. 18 is a cross-sectional view showing a positional relation among the locking pin 13, the guide groove 10*c*, and the rod 1 in the configuration in which the locking pin 13 is located at the position P1 of the guide groove 10*c* shown in FIG. 17. FIG. 19 is a cross-sectional view showing a positional relation among the locking pin 13, the guide groove 10*c*, and the rod 1 in the configuration in which the locking pin 13 is located at the position P2 of the guide groove 10*c* shown in FIG. 17.

As with the coupling structure 100 according to the present embodiment, the guide groove 10*c* is formed on the inner periphery of the receiving portion 9 according to Modification Example 3 in the circumferential direction of the receiving portion 9. However, the concave-convex shapes of the lines L1 and L2 are different from those of the guide groove 10*c* shown in FIG. 3.

Specifically, as shown in FIG. 17, regarding the line L1, two convex portions whose convex shapes are different in type from each other are formed in a region from the position of 0° to the position of 120°, that is, in a region where the slider 14 rotates 120°. These two convex portions whose convex shapes are different in type from each other are alternately formed. The angles shown in FIG. 17 are the center angles based on the central axis O of the receiving portion 9.

To be specific, the convex portion having one (convex shape A) of the convex shapes is formed in such a shape that: extends upward and straight from the insertion side toward the bottom side at the position of 0° in FIG. 17; and is then inclined from a peak of the upward extension to the insertion side in a gentle arc shape. This inclined section is located at the bottom side of a start position (the position of 0° in FIG. 17) of the convex portion having the convex shape A. A concave portion having a smooth bottom (position P1) is formed behind the convex shape A, and then, the convex portion having the other convex shape that is a convex shape B is formed.

The convex portion having the convex shape B starts from the position of substantially 60°, extends upward and straight from the position P1 toward the bottom portion side, and is inclined from a peak of the upward extension toward the insertion side in a gentle arc shape. When this inclination reaches a position that is the same in height as the position P1, the convex portion having the convex shape B then extends downward and straight toward the insertion side to reach a position that is the same in height as the start position of the convex portion having the convex shape A. A concave portion having a smooth bottom (position P2) is formed behind the convex portion having the convex shape B, and then, the convex portion having the convex shape A is again formed behind the position P2.

As above, the position P1 is located closer to a bottom side of the receiving portion 9 than the position P2. The convex portion having the convex shape A and the convex portion having the convex shape B alternately appear each time the slider 14 rotates substantially 60°. The convex portion having the convex shape A and the convex portion having the convex shape B do not have to be alternately formed. For example, the convex portions may be formed in order of the convex shape A, the convex shape B, the convex shape B, the convex shape A, and so on. It is preferable that each of the number of convex shapes A and the number of convex shapes B be an integral multiple of the number of locking pins 13 of the slider 14. With this, for example, a plurality of locking pins 13 can sandwich the rod 1, fix the rod 1, and cancel the fixing of the rod 1. FIG. 17 shows the line L1 in a case where the number of locking pins 13 is three.

The concave-convex portion of the line L2 in the receiving portion 9 according to Modification Example 3 is formed such that the convex portion thereof is located at a position displaced from the convex portion of the line L1 by substantially 30°. Specifically, as shown in FIG. 17, each of the convex portions of the line L2 is formed so as to: extend upward and straight toward the insertion side in the receiving portion 9 from a position (G1) displaced from the start position (0°) of the convex portion of the convex shape A of the line L1 by substantially 30°; and be inclined from a peak of the upward extension toward the bottom side in an arc shape, and these convex portions are repeatedly formed.

In the coupling structure 100 according to Modification Example 3, the rod 1 including at the pointed end thereof a spherical portion (engagement portion) 1*d* having a spherical shape as shown in FIG. 15 is inserted into the receiving portion 9 including the guide groove 10*c* formed as above. When the rod 1 is inserted, three locking pins 13 of the slider 14 are pushed by the pointed end of the rod 1 to move to the outside of the slider 14.

When the rod 1 is further inserted, the pressing pin 15 is pushed down, and then, the slider 14 is pushed toward the bottom side of the receiving portion 9. Thus, as shown in the lower side of FIG. 15, the rod 1 contacts the pressing pin 15 and the slider 14. At this time, the locking pin 13 pushed by the rod 1 moves along the inclination of the line L2 that is the concave-convex portion formed at the bottom side of the guide groove 10*c* and contacts the straight downward extension portion of the line L2 to stop (position G1 in FIG. 17). By the movement of the locking pin 13, the slider 14 rotates in a direction opposite to the direction in the case of the configuration of the guide groove 10*c* having the groove shape shown in FIG. 3.

When the force acting on the rod 1 is released, the pressing pin 15 presses the rod 1 and the slider 14 toward the insertion side of the receiving portion 9 by the restoring force of the pressing spring 16. With this, the locking pin 13 moves along the inclined portion of the convex portion of the convex shape A of the line L1 to reach the bottom (P1) of the concave portion formed between the convex portion having the convex shape A and the convex portion having the convex shape B. Then, the locking pin 13 contacts the line L1 at this position P1 to stop.

Further, when the force for inserting the rod 1 into the receiving portion 9 is applied to the rod 1, the locking pin 13 moves toward the bottom side to contact the line L2. Then, the locking pin 13 moves along the inclination of the line L2 and then contacts the straight upward extension portion (G2 in FIG. 17) of the convex portion of the line L2 to stop. By the movement of the locking pin 13, the slider 14 further rotates in a direction opposite to the direction in the case of the configuration of the guide groove 10*c* having the groove shape shown in FIG. 3.

When the force acting on the rod 1 is released, the pressing pin 15 presses the rod 1 and the slider 14 toward the insertion side of the receiving portion 9 by the restoring force of the pressing spring 16. With this, the locking pin 13 moves along the inclined portion of the convex portion of the convex shape B of the line L1 to reach the bottom (P1) of the concave portion formed between the convex portion having the convex shape A and the convex portion having the convex shape B. Then, the locking pin 13 contacts the line L1 at the position P1 to stop. As above, by applying the force for inserting the rod 1 and releasing the force, the locking pin 13 alternately moves to the two positions P1 and P2.

As shown in FIG. 18, in the cross-sectional shape of the receiving portion 9 at the position P1 in Modification Example 3, an interval between the slider 14 and the inner peripheral surface of the receiving portion 9 constituted by the insertion passage 10*b* and the guide groove 10*c* is substantially the same as a width of the outer peripheral end of the locking pin 13. Therefore, when the locking pin 13 is located at the position P1, the locking pin 13 is pushed into the slider 14 by the inner peripheral surface (the insertion passage 10*b* and the guide groove 10*c*) of the receiving portion 9.

With this, as shown in FIG. 18, a constricted portion 1*e* that is a boundary between a straight portion of the rod 1 and the spherical portion 1*d* that is the tip end portion of the rod 1 is sandwiched by three locking pins 13. Thus, the rod 1 is fixed by the locking pins 13, and even when strong force for pulling out the rod 1 from the receiving portion 9 is applied to the rod 1, the movement of the spherical portion 1*d* is inhibited by the locking pins 13. Therefore, the rod 1 can be firmly coupled to the inside of the receiving portion 9 (the first position).

In the receiving portion 9 according to Modification Example 3, when the locking pin 13 stops at the position P2 of the line L1, as shown in FIG. 19, an interval larger than the interval formed when the locking pin 13 is located at the position P1 is formed between the slider 14 and the inner peripheral surface (the insertion passage 10*b*) of the receiving portion 9. Specifically, this interval is set to such a size that the locking pin 13 can move, that is, that the inner peripheral edge of the locking pin 13 is flush with the inner peripheral surface of the slider 14 or located at an outer peripheral side of the inner peripheral surface of the slider 14.

Therefore, when the force for pulling out the rod 1 from the receiving portion 9 is applied to the rod 1, the locking pin 13 is pushed to the outside of the slider 14 by the spherical portion 1*d* of the rod 1, and the rod 1 is pulled out. To be specific, the coupling between the rod 1 and the receiving portion 9 is canceled (second position).

Modification Example 3 is configured such that the position of the slider 14 when the locking pin 13 stops at the position P2 of the line L1 is the second position; and the position of the slider 14 when the locking pin 13 stops at the position P1 of the line L1 is the first position. However, Modification Example 3 may be configured such that: the position of the slider 14 when the locking pin 13 stops at the position P1 of the line L1 is the second position; and the position of the slider 14 when the locking pin 13 stops at the position P2 of the line L1 is the first position.

In the case of commercializing the coupling structure 100, for example, the coupling structure 100 can be manufactured as below. Here, one example of a method of manufacturing the coupling structure 100 according to Modification Example 3 will be explained.

To be specific, the receiving portion 9 is constituted by an insertion-side receiving portion 9*b* and a bottom-side receiving portion 9*a*, which are obtained by dividing the receiving portion 9 at the guide groove 10*c* (see FIG. 15). Then, the insertion-side receiving portion 9*b* includes the insertion-side opening 10*a*, the insertion passage 10*b*, and a part of the guide groove 10*c*, and the bottom-side receiving portion 9*a* includes a part of the guide groove 10*c* and the accommodating portion 11. The insertion-side receiving portion 9*b* and the bottom-side receiving portion 9*a* are joined to each other, and a casing portion 2 wraps up the receiving portions 9*a* and 9*b*. Further, a first end (bottom-side end portion 2*e*) of the casing portion 2 is bent in a direction toward the inside of the receiving portion 9 to be firmly joined (swaged). As above, the insertion-side receiving portion 9*b* and the bottom-side receiving portion 9*a* are separately formed. Therefore, the guide groove 10*c* whose inner peripheral size is larger than that of the insertion passage 10*b*, the accommodating portion 11, or the like, can be easily manufactured without adopting, for example, a manufacturing method of putting a core and performing casting.

Various materials can be adopted for respective parts depending on the intended use. For example, the receiving portion 9 is made of a material, such as brass, which is harder than gold and silver, and the casing portion 2 is made of a precious metal, such as silver or gold. For example, by coating the casing portion 2 with a material that is the same as the material of the necklace or bracelet, beautiful appearance can be realized. In addition, in a case where the receiving portion 9 is made of a hard material, the abrasion resistance of the receiving portion 9 with respect to the slider 14 can be improved.

Embodiment 2

Next, the configuration of a coupling structure (accessory coupling structure) 200 according to Embodiment 2 as another embodiment will be explained in reference to FIGS. 20 to 28. The coupling structure 100 according to Embodiment 1 is configured such that the first position and the second position are switched in such a manner that the locking pin 13 of the slider 14 moves along the guide groove 10*c* in the receiving portion 9. In addition, the coupling structure 100 according to Embodiment 1 is configured such that when the locking pins 13 are located at the first position, the locking pins 13 sandwich the rod 1 to fix the rod 1.

To be specific, the locking pin 13 has two functions that are a guide function of guiding the slider 14 to a different position in the receiving portion 9 and a lock function of preventing the movement of the rod 1 in a pull-out direction. However, for example, as in the coupling structure 200 according to Embodiment 2 below, a member different from the locking pin 13 may perform the lock function.

Figure 20:
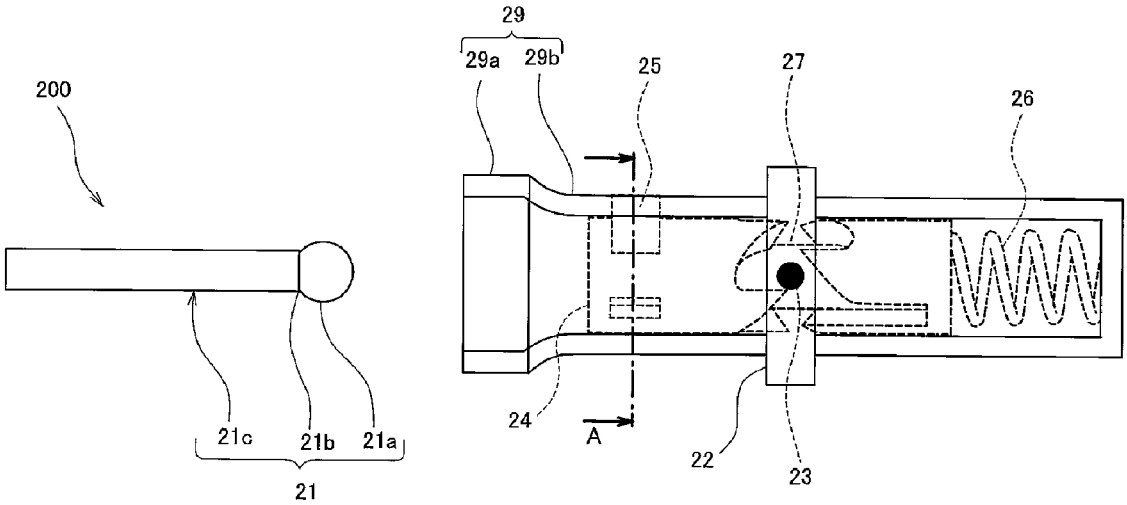
FIG. 20 is a side view showing major components of the coupling structure according to Embodiment 2.
Figure 21:
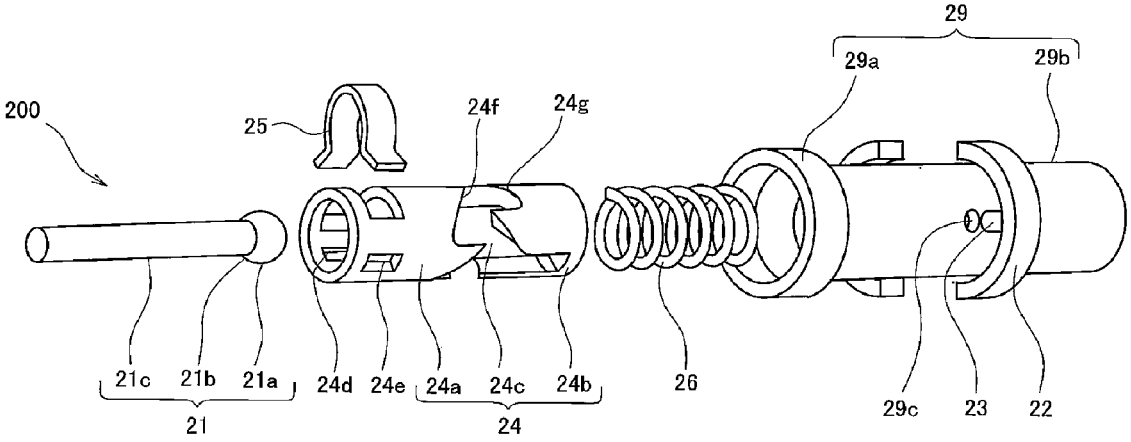
FIG. 21 is an assembly diagram showing respective members constituting the coupling structure shown in FIG. 20.

To be specific, as shown in FIGS. 20 and 21, the coupling structure 200 according to Embodiment 2 includes a rod 21 and a receiving portion 29.

As shown in FIGS. 20 and 21, the rod 21 includes: a straight portion 21*c* that is a rod-like member having a circular cross section; a spherical portion (engagement portion) 21*a* formed at the pointed end of the straight portion 21*c* and having a spherical shape; and a constricted portion 21*b* that is a joint portion between the straight portion 21*c* and the spherical portion 21*a*.

As shown in FIGS. 20 and 21, the receiving portion 29 is a cylindrical member which has a circular cross section and whose one end portion is open. The receiving portion 29 is constituted by: an insertion-side opening portion 29*a* on which an opening is formed; and an accommodating portion 29*b* that is a cylindrical portion extending straight from the insertion-side opening portion 29*a*.

The outer diameter and inner diameter of the cross section of the insertion-side opening portion 29*a* are respectively larger than those of the cross section of the accommodating portion 29*b*. For example, in a case where the diameter of the cross section of the straight portion 21*c* of the rod 1 is 0.8 mm, and the diameter of the spherical portion 21*a* is 1.2 mm, the outer diameter of the cross section of the insertion-side opening portion 29*a* of the receiving portion 29 is 4 mm, and the inner diameter thereof is about 3.2 mm.

The inner diameter of the insertion-side opening portion 29*a* is designed such that: the rod 1 can be smoothly inserted into the receiving portion 29; and when the rod 1 and the receiving portion 29 are in the coupled state, the rod 1 can freely move in the radial direction and circumferential direction of the insertion-side opening portion 29*a* to some extent.

For example, in a case where the outer diameter of the cross section of the insertion-side opening portion 29*a* is 4 mm, and the inner diameter thereof is about 3.2 mm, the outer diameter of the cross section of the accommodating portion 29*b* is 3.2 mm, and the inner diameter thereof is about 2.4 mm. The coupling structure 200 according to Embodiment 2 realizes the lock function by utilizing the difference between the inner diameter of the insertion-side opening portion 29*a* and the inner diameter of the accommodating portion 29*b*. Details will be described later. The inner diameters and outer diameters of the insertion-side opening portion 29*a* and accommodating portion 29*b* described herein are just examples and are not limited to the above diameters.

As shown in FIG. 20, the accommodating portion 29*b* of the receiving portion 29 accommodates a slider 24, a plate spring (coupling unit) 25, and a pressing spring 26 in this order from a side where the insertion-side opening portion 29*a* is provided. As shown in FIG. 21, two locking pin insertion holes 29*c* into which locking pins 23 are respectively inserted from the outside of the receiving portion 29 to the inside thereof are formed on a portion of a side surface of the accommodating portion 29*b*, the portion being located in the vicinity of a middle point of the accommodating portion 29*b* in the extending direction of the accommodating portion 29*b*. Each of the two locking pin insertion holes 29*c* is formed to extend in a direction substantially perpendicular to a direction (extending direction of the accommodating portion 29*b*) in which the rod 1 is inserted into the receiving portion 29. The positions of the locking pin insertion holes 29*c* are opposed to each other. An arc-shaped fixing portion 22 is joined to one end portion of the locking pin 23. The arc-shaped fixing portion 22 is bent along the side surface of the accommodating portion 29*b* in a circumferential direction of the accommodating portion 29*b* and can be fixed to the side surface of the accommodating portion 29*b*. Therefore, the locking pin 23 can be fixed by the arc-shaped fixing portion 22 so as to project from the side surface of the accommodating portion 29*b* toward the inside of the accommodating portion 29*b*.

As shown in FIG. 20, the pressing spring 26 is a compression coil spring that is provided at a bottom-side (base end-side) end portion, which is not open, of the accommodating portion 29*b* and expands and contracts in the insertion direction of the rod 1. The slider 24 adjacent to the pressing spring 26 can be pressed toward the insertion-side opening portion 29*a* by the restoring force of the pressing spring 26.

The slider 24 slides forward and backward in the insertion direction of the rod 1 while rotating in the receiving portion 29. An end portion of the slider 24 is closed, the end portion contacting the pressing spring 26. An end portion opposite to the above end portion of the slider 24 is open. More specifically, as shown in FIG. 21, the slider 24 includes: an insertion-side slide portion 24*a* provided at the insertion side (tip end side) of the receiving portion 29 and having an opening; a bottom-side slide portion 24*b* provided so as to contact the pressing spring 26; and a coupling portion 24*c* provided between the insertion-side slide portion 24*a* and the bottom-side slide portion 24*b* and configured to cause the insertion-side slide portion 24*a* and the bottom-side slide portion 24*b* to be coupled to each other. To be specific, as shown in FIGS. 20 and 21, the slider 24 is formed such that the insertion-side slide portion 24*a* and the bottom-side slide portion 24*b*, which are the same in the outer diameter as each other, sandwich the coupling portion 24*c* having a rod shape whose outer diameter is smaller than that of each of the insertion-side slide portion 24*a* and the bottom-side slide portion 24*b*.

A sawtooth-shaped insertion-side concave-convex portion 24*f* and a sawtooth-shaped bottom-side concave-convex portion 24*g* (a guide unit; a concave-convex portion) are respectively formed at opposing end portions of the insertion-side slide portion 24*a* and the bottom-side slide portion 24*b*. The insertion-side concave-convex portion 24*f* and the bottom-side concave-convex portion 24*g* are the same in function as the lines L1 and L2 of the guide groove 10*c* of the coupling structure 100 according to Embodiment 1.

Figure 22:
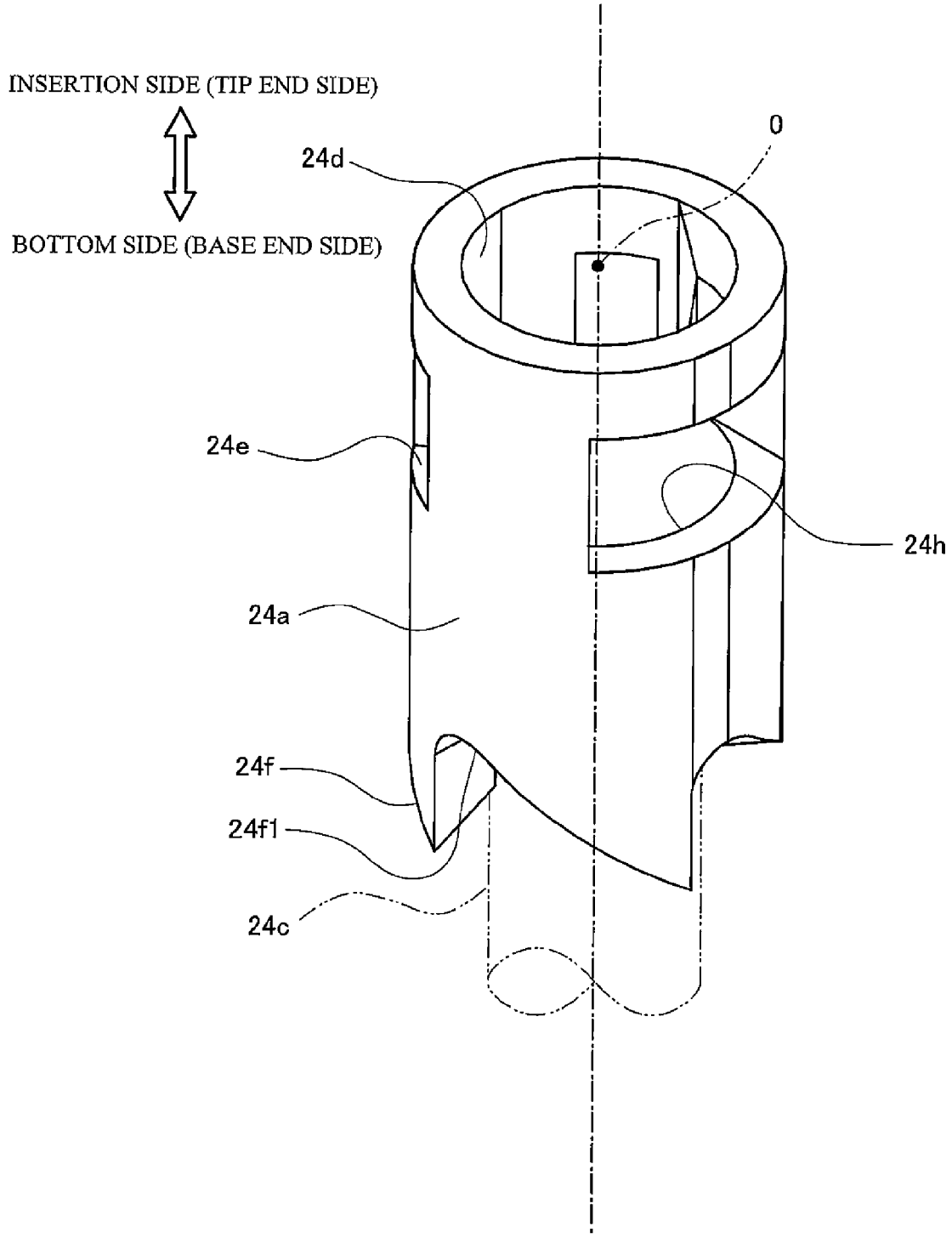
FIG. 22 is a perspective view showing the configuration of the slider (tip end-side slide portion) included in the coupling structure shown in FIG. 20.

Here, the structure of the insertion-side slide portion 24*a* will be explained in more detail in reference to FIG. 22. As shown in FIG. 22, the insertion-side slide portion 24*a* is formed in a cylindrical shape having a substantially circular cross section. A central axis of the insertion-side slide portion 24 having the cylindrical shape coincides with the central axis O of the receiving portion 9.

A first opening portion 24*d* that is an opening capable of receiving the rod 1 is formed on an insertion-side end surface of the insertion-side slide portion 24*a*, and a second opening portion 24*h* that opens on a surface parallel to a surface on which the first opening portion 24*d* is formed is formed closer to the bottom side than the first opening portion 24*d*. The first opening portion 24*c*1 and the second opening portion 24*h* are formed such that both centers thereof are located on the central axis O.

Three openings (plate spring insertion opening 24*e*) are formed on a side surface of the insertion-side slide portion 24*a*, the side surface being located between the first opening portion 24*d* and the second opening portion 24*h*. Therefore, as shown in FIG. 22, a portion between the surface on which the first opening portion 24*d* is formed and the surface on which the second opening portion 24*h* is formed is supported by three side walls.

As shown in FIG. 22, the end portion of outer peripheral side surface of the insertion-side slide portion 24*a* at the insertion-side concave-convex portion 24*f* is constituted by continuous convex portions each formed to: gently extend upward toward the bottom side; reaches a peak at a predetermined position; and extend downward and straight toward the insertion side. Therefore, when the locking pin 23 is located at the bottom of the concave portion of the insertion-side concave-convex portion 24*f*, the locking pin 23 can move toward the oblique surface that gently extends downward but cannot move toward the oblique surface that extends upward and straight.

As shown in FIG. 22, the rod-shaped coupling portion 24*c* projects from an end portion, where the insertion-side concave-convex portion 24*f* is formed, of the insertion-side slide portion 24*a*.

Figure 23:
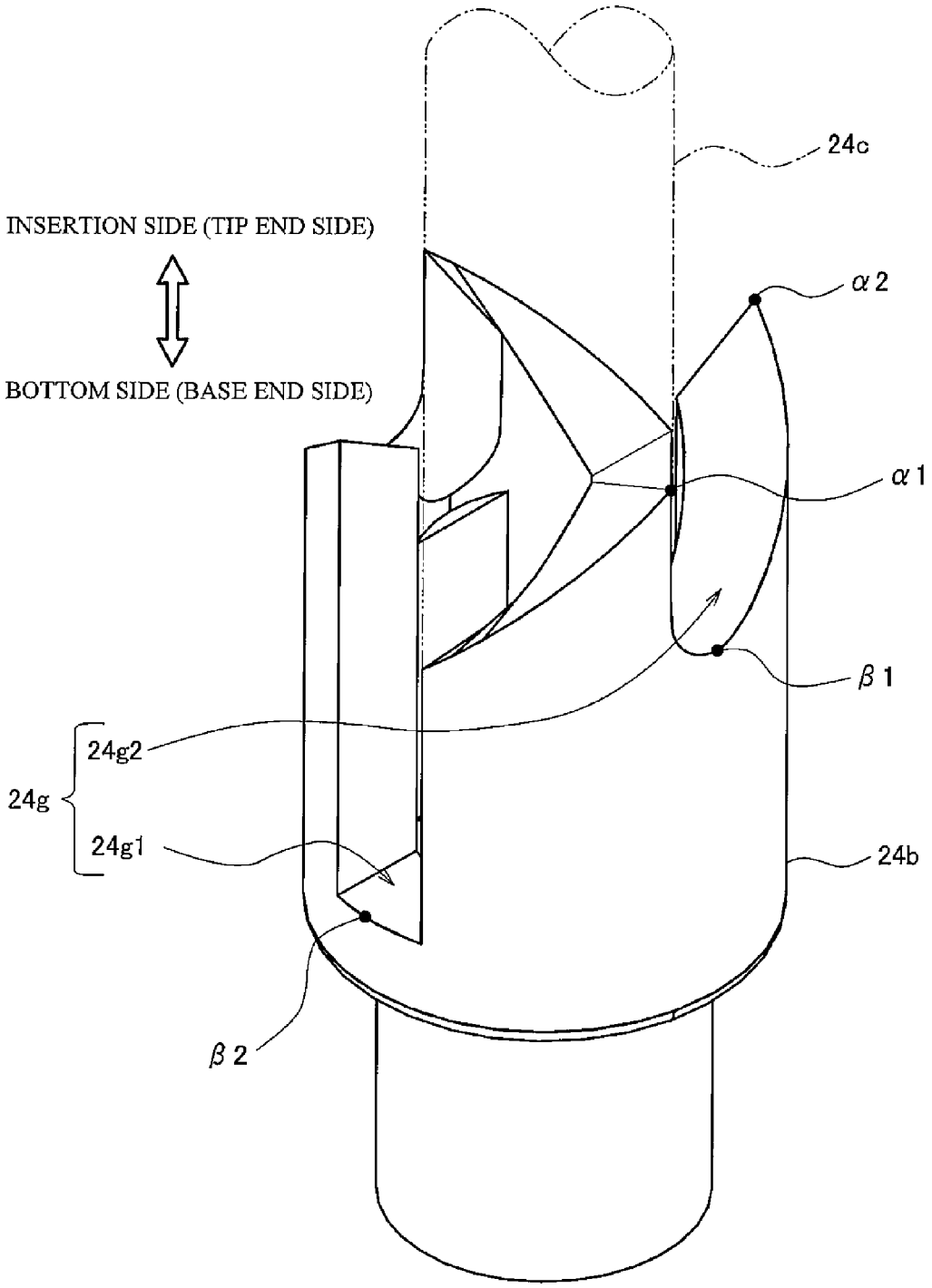
FIG. 23 is a perspective view showing the configuration of the slider (base end-side slide portion) included in the coupling structure shown in FIG. 20.

Next, the bottom-side slide portion 24*b* joined to the insertion-side slide portion 24*a* via the coupling portion 24*c* will be explained. As shown in FIG. 23, the bottom-side concave-convex portion 24*g* projecting toward the insertion-side slide portion 24*a* is formed at an outer periphery of the insertion-side (tip end-side) end surface (end surface where the coupling portion 24*c* is provided) of the bottom-side slide portion 24*b*.

As shown in FIG. 23, convex portions including two types of convex shapes are formed as the bottom-side concave-convex portion 24*g*. First, the convex portion having one of two types of convex shapes is formed to: extend upward and straight toward the insertion side (tip end side) from a bottom β2 that is the bottom of the concave portion of the bottom-side slide portion 24*b*; be then gently inclined in an arc shape; and further extend upward to reach a peak α1. Then, the convex portion of the above type extends downward and straight from the peak α1 toward the bottom side (base end side) to a position that is the same in height as the start position of the gentle inclination, to reach a bottom β1 that is the bottom of the concave portion. The convex portion having the other type of convex shape is formed to: extend upward from the bottom β1 toward insertion side (tip end side) while being gently inclined; reach a peak α2; and extend downward and straight from the peak α2 toward the bottom side (base end side) to reach the bottom β2.

Especially, in the bottom-side slide portion 24*b*, the bottom β2 is located closer to the bottom side (base end side) than the bottom β1. In the bottom-side slide portion 24*b* according to Embodiment 2, the concave portion including the bottom β2 is referred to as a concave portion 24*g*1, and the concave portion including the bottom β1 is referred to as a concave portion 24*g*2. The concave portion 24*g*1 and the concave portion 24*g*2 are formed at positions different from each other in the insertion direction of the rod 21.

Figure 24:
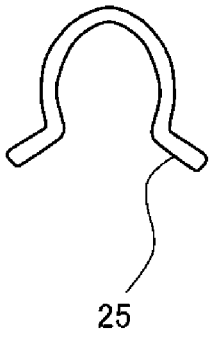
FIG. 24 is a side view showing one example of the shape of a side surface of a plate spring attached to the slider included in the coupling structure shown in FIG. 20, when viewed from a tip end side.
Figure 25:
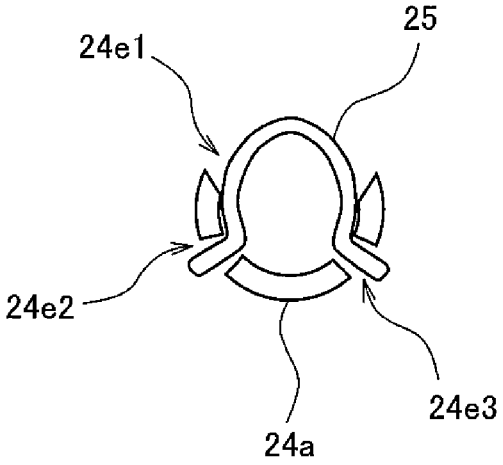
FIG. 25 is a cross-sectional view taken along line A-A of FIG. 20 and shows the receiving portion in the coupling structure of FIG. 20.

Next, the plate spring 25 inserted into the plate spring insertion opening 24*e* of the insertion-side slide portion 24 will be explained. The plate spring 25 has such a shape that: a long and thin rectangular metal plate is bent in a horseshoe shape as shown in FIG. 24; and both end portions of the plate are bent so as to open outward. FIG. 24 is a side view showing one example of the shape of the side surface of the plate spring 25 attached to the slider 24 according to Embodiment 2, when viewed from the insertion side. FIG. 25 shows a state where the plate spring 25 is attached to three plate spring insertion openings 24*e*1, 24*e*2, and 24*e*3 formed on the side surface of the slider 24. FIG. 25 is a cross-sectional view taken along line A-A of FIG. 20 and shows the receiving portion 29 in the coupling structure 200 shown in FIG. 20.

To be specific, the plate spring insertion opening 24*e*1 that is the largest in size in the plate spring insertion opening 24*e* and the plate spring insertion openings 24*e*2 and 24*e*3 that are smaller than the plate spring insertion opening 24*e*1 are formed on the insertion-side slide portion 24*a*. Then, the plate spring 25 is attached to the insertion-side slide portion 24*a* such that: the end portions thereof that are bent so as to spread outward project from the inside of the slide portion 24 to the outside through the plate spring insertion openings 24*e*2 and 24*e*3, respectively; and a part of the bent portion of the plate spring 25 projects from the plate spring insertion opening 24*e*1. To be specific, the bent plate spring 25 generates force for causing the plate spring 25 to return to the flat plate shape. Therefore, the end portions of the plate spring 25 that are bent outward respectively press a side surface located between the plate spring insertion opening 24*e*1 and the plate spring insertion opening 24*e*2 and a side surface located between the plate spring insertion opening 24*e*1 and the plate spring insertion opening 24*e*3. As a result, the plate spring 25 is fixed to the slider 24.

For example, as shown in FIG. 21, the coupling structure 200 according to Embodiment 2 configured as above is assembled as below. To be specific, the receiving portion 29 accommodates the pressing spring 26 and the slider 24 to which the plate spring 25 is attached. Then, the locking pins 23 are inserted into an interval formed between the insertion-side slide portion 24*a* and the bottom-side slide portion 24*b* in the slider 24 (that is, an interval formed between the insertion-side concave-convex portion 24*f* and the bottom-side concave-convex portion 24*g*) to be fixed to the side surface of the receiving portion 29. With this, even in a case where the slider 24 is pressed toward the insertion side of the receiving portion 29 by the pressing spring 26, the slider 24 is prevented from jumping out of the receiving portion 29.

The coupling structure 200 according to Embodiment 2 configured as above can perform the switching of the position to the first position or the second position, the coupling between the rod 21 and the receiving portion 29, and the canceling of the coupling by the following operations.

Figure 26:
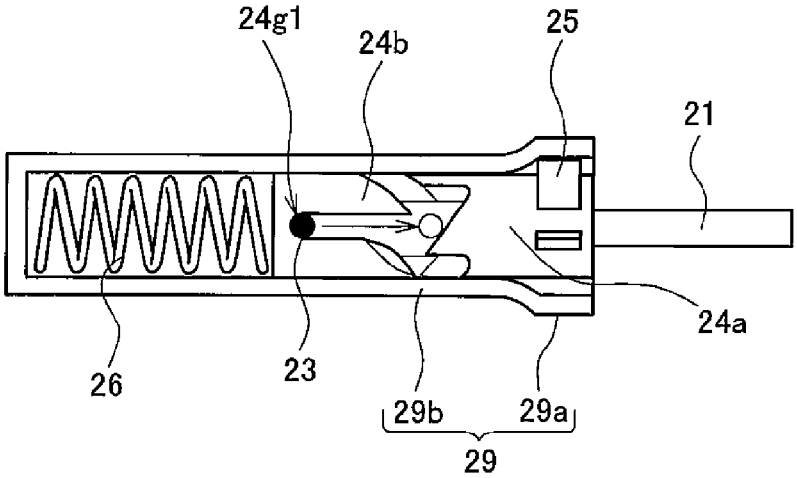
FIG. 26 is a side view schematically showing a state where the insertion of the rod into the receiving portion is started in the coupling structure shown in FIG. 20.
Figure 29:
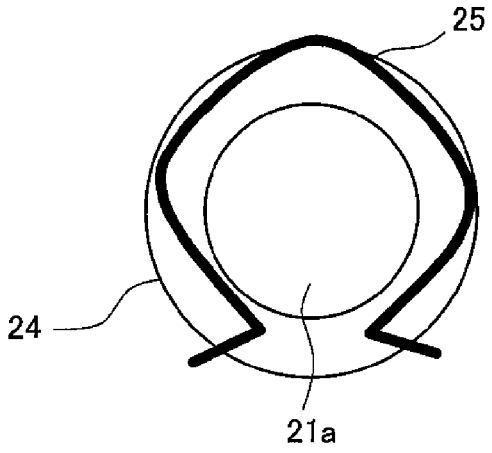
FIG. 29 is a cross-sectional view schematically showing a positional relation among the slider, the plate spring, and a spherical portion of the rod when the plate spring is located at an insertion-side opening portion of the receiving portion in the coupling structure shown in FIG. 20.

First, when inserting the rod 21 into the receiving portion 29, the slider 24 is pressed toward the insertion side of the receiving portion 29 by the pressing spring 26, and as shown in FIG. 26, the locking pin 23 is located at such a position as to contact the concave portion 24*g*1 of the bottom-side concave-convex portion 24*g*. At this time, the plate spring 25 attached to the insertion-side slide portion 24*a* is located at the insertion-side opening portion 29*a* of the receiving portion 29, and as shown in FIG. 29, both end portions and bent portion of the plate spring 24 project from the plate spring insertion opening 24. FIG. 29 is a cross-sectional view schematically showing a positional relation among the slider 24, the plate spring 25, and the spherical portion 21*a* of the rod 21 when the plate spring 25 is located at the insertion-side opening portion 29*a* of the receiving portion 29 in the coupling structure 200 shown in FIG. 20.

In a state where the plate spring 25 is attached to the slider 24 as shown in FIG. 29, a circular portion formed by bending the plate spring 25 in the receiving portion 29 is larger than the diameter of the spherical portion 21*a* of the rod 21. Therefore, the spherical portion 21*a* of the rod 21 can freely move forward and backward in the insertion direction in a space surrounded by the circular portion of the plate spring 25 without being inhibited by the plate spring 25.

Next, when the rod 21 is inserted into the receiving portion 29, the slider 24 is pushed toward the bottom side of the receiving portion 29 by the rod 21. As a result, the locking pin 23 located at the concave portion 24*g*1 of the bottom-side concave-convex portion 24*g* contacts the insertion-side concave-convex portion 24*f* and moves along the concave-convex shape of the insertion-side concave-convex portion 24*f* to stop at a concave portion 24*f*1 of the insertion-side concave-convex portion 24*f* (see FIG. 27). To be specific, the position of the locking pin 23 changes from the position shown in FIG. 26 to the position shown in FIG. 27. At this time, the slider 24 has rotated 45° from the initial position (position shown in FIG. 26).

Figure 27:
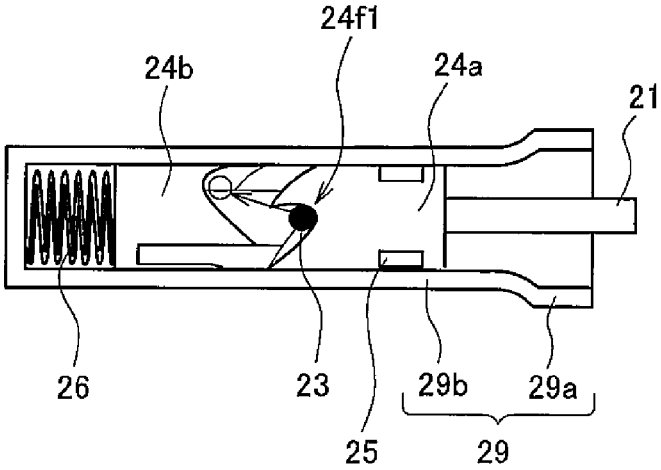
FIG. 27 is a side view schematically showing a state where the rod is inserted into the receiving portion in the coupling structure shown in FIG. 20.
Figure 28:
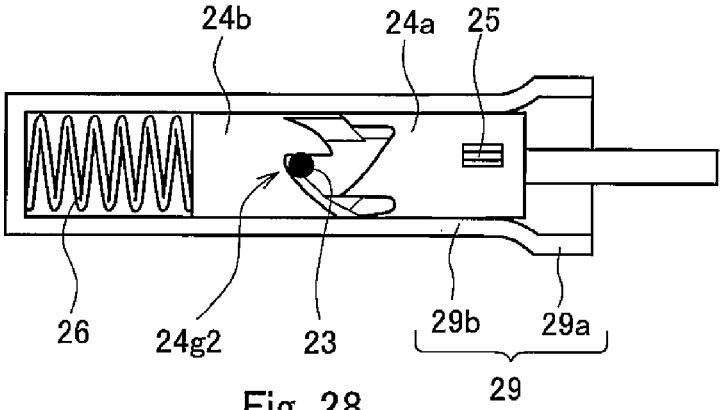
FIG. 28 is a side view schematically showing a state where force for inserting the rod into the receiving portion is released in the coupling structure shown in FIG. 20.

As shown in FIG. 27, when the force for inserting the rod 1 into the receiving portion 29 is released in a state where the locking pin 23 contacts the concave portion 24*f*1 of the insertion-side concave-convex portion 24*f* to stop at this position, the slider 24 is pressed toward the insertion side of the receiving portion 29 by the pressing spring 26. At this time, the slider 24 is rotated 45° from the position shown in FIG. 27 to be located at the position shown in FIG. 28. To be specific, as shown in FIG. 28, the locking pin 23 contacts the concave portion 24*g*2 of the bottom-side concave-convex portion 24*g* to stop at this position.

As a result, in the coupling structure 200 according to Embodiment 2, while the locking pin 23 moves from the concave portion 24*g*1 of the bottom-side concave-convex portion 24*g* to the concave portion 24*g*2, the locking pin 23 rotates 90° from the initial position.

Figure 30:
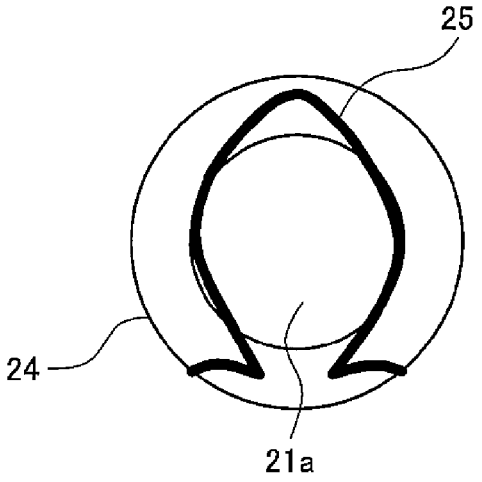
FIG. 30 is a cross-sectional view schematically showing a positional relation among the slider, the plate spring, and the spherical portion of the rod when the plate spring is located at an accommodating portion of the receiving portion in the coupling structure shown in FIG. 20.

When the locking pin 23 is located at the concave portion 24*g*2, the plate spring 25 included in the insertion-side slide portion 24*a* is located in the accommodating portion 29*b*, and both end portions and bent portion of the plate spring 25 project little from the plate spring insertion opening 24. Therefore, as shown in FIG. 30, the plate spring 25 is accommodated in the slide portion 24 in a further bent state, and the circular portion formed by bending the plate spring 25 becomes smaller than the diameter of the spherical portion 21*a* of the rod 1. With this, even in a case where the spherical portion 21*a* of the rod 1 tries to move from the bottom side of the receiving portion 29 toward the insertion side, this movement is inhibited by the plate spring 25, so that the rod 21 cannot be pulled out from the receiving portion 29. To be specific, in the coupling structure 200 according to Embodiment 2, when the locking pin 23 is located at the concave portion 24*g*2 of the bottom-side concave-convex portion 24*g*, the position of the slider 24 becomes the first position.

When the rod 1 is inserted again, the slider 24 is pushed toward the bottom side of the receiving portion 29 by the rod 1. As a result, the locking pin 23 located at the concave portion 24*g*2 of the bottom-side concave-convex portion 24*g* contacts the insertion-side concave-convex portion 24*f* to move along the insertion-side concave-convex portion 24*f*. Then, the locking pin 23 contacts the concave portion 24*f*1 of the insertion-side concave-convex portion 24*f* to stop at this position.

When the force for inserting the rod 1 into the receiving portion 29 is released, the slider 24 is pressed toward the insertion side of the receiving portion 29 by the pressing spring 26. Therefore, as shown in FIG. 26, the locking pin 23 contacts the concave portion 24*g*1 of the bottom-side concave-convex portion 24*g* to stop at this position. At this time, the plate spring 25 included in the insertion-side slide portion 24*a* is located at the insertion-side opening portion 29*a*, and as shown in FIG. 29, both end portions and bent portion of the plate spring 25 project from the plate spring insertion opening 24*e*.

Therefore, the spherical portion 21*a* of the rod 1 can freely move forward and backward in the insertion direction in the space surrounded by the circular portion of the plate spring 25. To be specific, in the coupling structure 200 according to Embodiment 2, when the locking pin 23 is located at the concave portion 24*g*1 of the bottom-side concave-convex portion 24*g*, the position of the slider 24 becomes the second position.

As above, the coupling structure 200 according to Embodiment 2 can easily perform the coupling between the rod 21 and the receiving portion 29 and cancel the coupled state.

The plate spring 25 according to Embodiment 2 is attached to the slider 24 so as to be inserted into the plate spring insertion opening 24*e* of the slider 24. However, the present embodiment is not limited to the case where the plate spring 25 and the slider 24 are separately provided, and the plate spring 25 and the slider 24 may be formed integrally.

Hereinafter, a case where the plate spring 25 and the slider 24 are formed integrally will be explained as Modification Example of the coupling structure 200 according to Embodiment 2.

Modification Example 1

Figure 31:
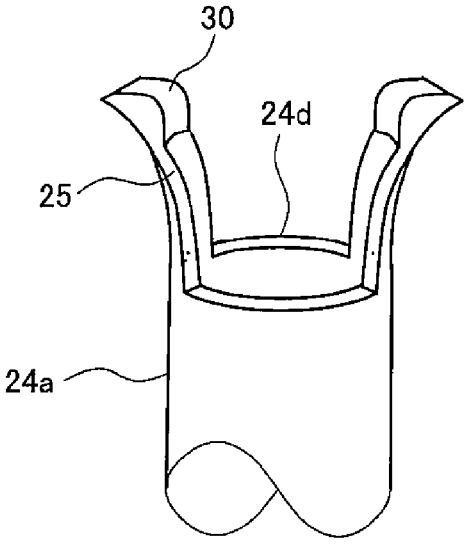
FIG. 31 is a perspective view showing one example of the slider of the coupling structure according to Embodiment 2.

As described above, the coupling structure 200 according to Embodiment 2 is configured such that the plate spring insertion opening 24*e* is formed on the insertion-side slide portion 24*a* of the slider 24; and the plate spring 25 is attached to the plate spring insertion opening 24*e*. As shown in FIG. 31, the coupling structure 200 according to Modification Example 1 of Embodiment 2 is configured such that two plate springs 25 as a coupling unit of the present invention are attached to opposing positions on an outer periphery of the first opening portion 24*d*. FIG. 31 is a perspective view showing one example of the slider 24 in the coupling structure 200 according to Embodiment 2. For convenience of explanation, FIG. 31 shows only the vicinity of an insertion-side end portion of the insertion-side slide portion 24*a* of the slider 24.

As above, the slider 24 according to Modification Example 1 of Embodiment 2 is different from the slider 24 of Embodiment 2 regarding only the shape of the insertion-side end portion of the insertion-side slide portion 24*a*. Therefore, the shape of the insertion-side end portion of the insertion-side slide portion 24*a* will be explained, and explanations of the other components are omitted.

The plate springs 25 project from the first opening portion 24*d* toward the insertion side of the receiving portion 29, and tip end portions thereof are bent in a radially outward direction of the first opening portion 24*d*. Substantially semicylindrical plate spring contact portions 30 are respectively formed at the tip end portions of the plate springs 25. Here, when the plate springs 25 are coupled to the rod 21, tip end portions thereof contact the rod 21 to prevent the rod 1 from coming out from the receiving portion 29. Details will be described later.

As described above, since the plate spring 25 includes the plate spring contact portion 30, the strength of the end portion that contacts the rod 21 can be improved. Since the plate spring contact portion 30 has a substantially semicylindrical shape, the wearer of the necklace can be prevented from getting hurt by contact with the tip end portion of the plate spring 25.

Figure 32:
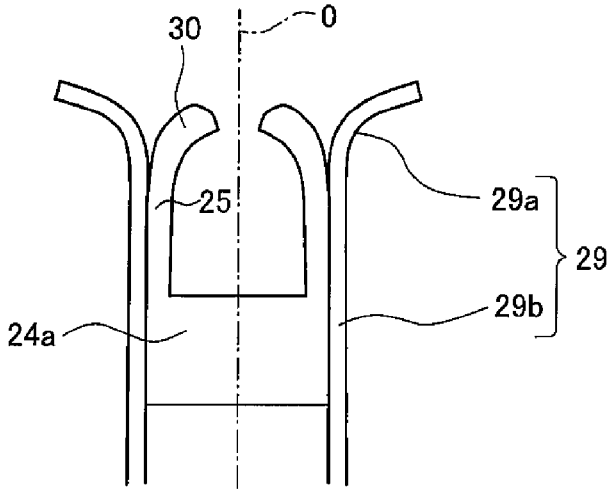
FIG. 32 is a cross-sectional view schematically showing one example of an arrangement relation between the receiving portion and the slider in the coupling structure according to Modification Example 1 of Embodiment 2.
Figure 33:
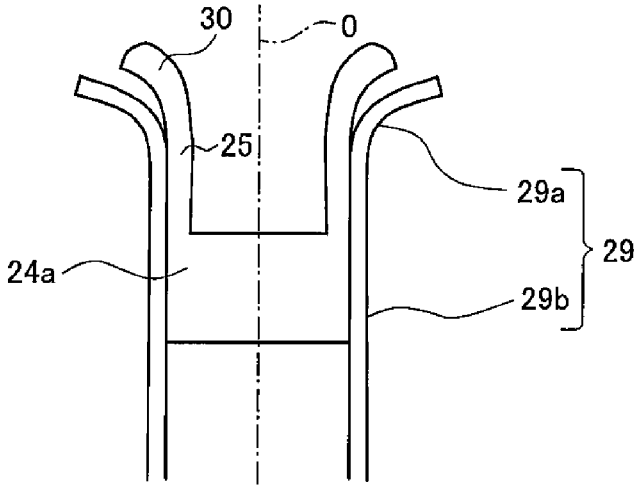
FIG. 33 is a cross-sectional view schematically showing one example of the arrangement relation between the receiving portion and the slider in the coupling structure according to Modification Example 1 of Embodiment 2.

As shown in FIGS. 32 and 33, in the cross-sectional shape of the receiving portion 29 in the coupling structure 200 according to Modification Example 2 of Embodiment 2, the side surface of the receiving portion 29 extends straight from the accommodating portion 29*b* to the insertion-side opening portion 29*a*. Then, the side surface of the receiving portion 29 projects from the insertion-side opening portion 29*a* so as to spread in a radially outward direction of the insertion-side opening portion 29*a*.

FIGS. 32 and 33 are cross-sectional views each schematically showing one example of an arrangement relation between the receiving portion 29 and the slider 24 in the coupling structure 200 according to Modification Example 1 of Embodiment 2. For convenience of explanation, each of FIGS. 32 and 33 schematically shows only an insertion-side half of the receiving portion 29 and the insertion-side slide portion 24*a*. To be specific, the receiving portion 29 according to Modification Example 2 of Embodiment 2 is the same as the receiving portion 29 explained in Embodiment 2 except for the shape of the side surface in the vicinity of the insertion-side opening portion 29*a*. Therefore, only the difference therebetween regarding the receiving portion 29 will be explained, and explanations of the other components are omitted.

As described above, in the coupling structure 200 according to Embodiment 2, when the locking pin 23 contacts the concave portion 24*g*1 of the bottom-side concave-convex portion 24*g* to stop at this position, the position of the slider 24 becomes the second position. In contrast, when the locking pin 23 contacts the concave portion 24*g*2 of the bottom-side concave-convex portion 24*g* to stop at this position, the position of the slider 24 becomes the first position.

The position of the slider 24 when the locking pin 23 is located at the second position is closer to the insertion side of the receiving portion 29 than the position of the slider 24 when the locking pin 23 is located at the first position. To be specific, the coupling structure 200 according to Embodiment 2 switches between the position (insertion-side position) of the slider 24 when the locking pin 23 is located at the first position and the position (bottom-side position) of the slider 24 when the locking pin 23 is located at the second position to perform the coupling between the rod 21 and the receiving portion 29 or cancel this coupling.

Similarly, the coupling structure 200 according to Modification Example 1 of Embodiment 2 switches the position of the slider 24 to perform the coupling between the rod 21 and the receiving portion 29 or cancel this coupling.

More specifically, as shown in FIG. 32, when the slider 24 is located at the bottom-side position of the receiving portion 29, the tip end portion of the plate spring 25 is pressed by an inner peripheral side surface of the receiving portion 29 toward the central axis O. With this, the inner diameter of the slider 24 is reduced by the tip end portion of the plate spring 25. Therefore, when pulling out the rod 21 from the receiving portion 29, the plate spring contact portion 30 and the spherical portion 21*a* of the rod 21 contact each other. Thus, the rod 21 cannot be pulled out. That is, the coupled state between the rod 21 and the receiving portion 29 is realized.

As shown in FIG. 33, when the slider 24 is located at the insertion-side position of the receiving portion 29, by the outwardly spreading shape of the receiving portion 29 in the vicinity of the insertion-side opening portion 29*a*, the tip end portion of the plate spring 25 becomes the same outwardly spreading shape as the receiving portion 29.

Therefore, the size of the opening of the slider 24 is not reduced by the tip end portion of the plate spring 25 and becomes such an adequate size that allows the spherical portion 21*a* of the rod 21 to pass therethrough. Thus, the rod 21 can be easily pulled out from the receiving portion 29. To be specific, the coupled state between the rod 21 and the receiving portion 29 is canceled.

Modification Example 2

As described above, in the coupling structure 200 according to Modification Example 1 of Embodiment 2, when the locking pin 23 is located at such a position as to contact the concave portion 24*g*2, that is, when the slider 24 is located at the bottom-side position, the coupled state between the rod 21 and the receiving portion 29 is realized. In contrast, when the locking pin 23 is located at the concave portion 24*g*1, that is, when the slider 24 is located at the insertion-side position, the coupled state is canceled.

However, in Modification Example 2 of Embodiment 2, when the locking pin 23 is located at such a position as to contact the concave portion 24*g*2, that is, when the slider 24 is located at the bottom-side position, the coupling between the rod 21 and the receiving portion 29 is canceled. In contrast, when the locking pin 23 is located at such a position as to contact the concave portion 24*g*1, that is, when the slider 24 is located at the insertion-side position, the coupled state is realized.

More specifically, the slider 24 in the coupling structure 200 according to Modification Example 2 of Embodiment 2 is the same in configuration as the slider 24 according to Modification Example 1 of Embodiment 2. Therefore, an explanation of the configuration of the slider 24 is omitted.

The outer diameter and inner diameter of the receiving portion 29 in the vicinity of the insertion-side opening portion 29*a* are different from those of the receiving portion 29 explained in Modification Example 1 of Embodiment 2. Other than the above, the receiving portion 29 according to Modification Example 2 of Embodiment 2 is the same as the receiving portion 29 explained in Modification Example 1 of Embodiment 2. Therefore, only the difference therebetween regarding the receiving portion 29 will be explained.

Figure 34:
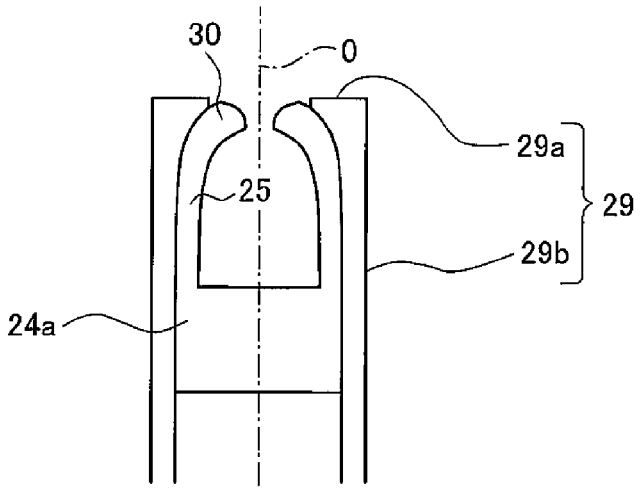
FIG. 34 is a cross-sectional view schematically showing one example of the arrangement relation between the receiving portion and the slider in the coupling structure according to Modification Example 2 of Embodiment 2.
Figure 35:
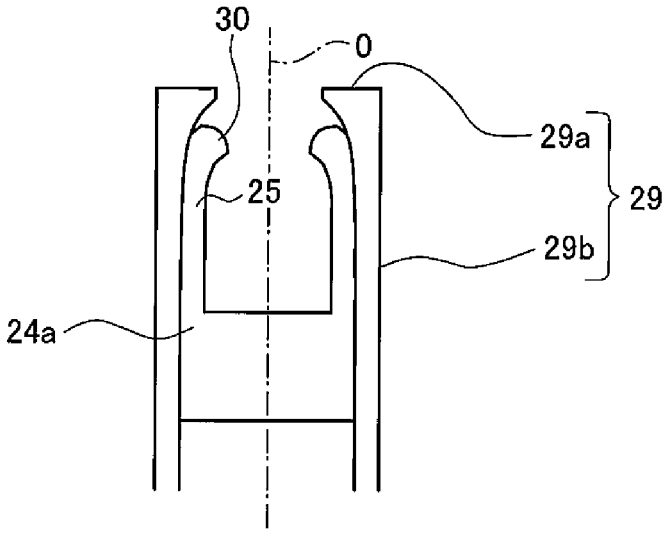
FIG. 35 is a cross-sectional view schematically showing one example of the arrangement relation between the receiving portion and the slider in the coupling structure according to Modification Example 2 of Embodiment 2.

As shown in FIGS. 34 and 35, the outer diameter of the receiving portion 9 according to Modification Example 2 of Embodiment 2 is constant in a range from the insertion-side opening portion 29*a* to the accommodating portion 29*b*, but the inner diameter of the receiving portion 9 in a range from the accommodating portion 29*b* to the insertion-side opening portion 29*a* has a tapered shape.

FIGS. 34 and 35 are cross-sectional views each schematically showing one example of an arrangement relation between the receiving portion 29 and the slider 24 in the coupling structure 200 according to Modification Example 2 of Embodiment 2. For convenience of explanation, each of FIGS. 34 and 35 schematically shows only an insertion-side half of the receiving portion 29 and the insertion-side slide portion 24*a*.

More specifically, as shown in FIG. 34, when the slider 24 is located at the insertion-side position, the tip end portions of the plate springs 25 that realize the coupling unit of the present invention are pressed toward the central axis O by the inner peripheral side surface that has the tapered shape in the vicinity of the insertion-side opening portion 29*a* of the receiving portion 29. With this, the inner diameter of the slider 24 is reduced by the tip end portions of the plate springs 25.

Therefore, when pulling out the rod 21 from the receiving portion 29, the plate spring contact portion 30 and the spherical portion 21*a* of the rod 21 contact each other, so that the rod 1 cannot be pulled out. To be specific, the coupled state between the rod 21 and the receiving portion 29 is realized.

In contrast, as shown in FIG. 35, when the slider 24 is located at the bottom-side position, the plate springs 25 are arranged along the inner peripheral side surface of the receiving portion 29. Therefore, at the position where the tip end portions of the plate springs 25 are provided, the inner diameter of the slider 24 is not reduced and is such an adequate size that the spherical portion 21*a* of the rod 21 can pass through the slider 24. On this account, the rod 21 can be easily pulled out from the receiving portion 29. To be specific, the coupled state between the rod 21 and the receiving portion 29 is canceled.

Modification Example 3

The coupling structure 200 according to Modification Example 1 of Embodiment 2 is configured such that: when the locking pin 23 is located at the concave portion 24*g*2 of the bottom-side concave-convex portion 24*g*, the coupled state between the rod 21 and the receiving portion 29 is realized; and when the locking pin 23 is located at the concave portion 24*g*1 of the bottom-side concave-convex portion 24*g*, the coupled state is canceled. To be specific, the coupling structure 200 is configured to realize the coupled state between the rod 21 and the receiving portion 29 or cancel the coupled state depending on whether the slider 24 is located at the bottom side or the insertion side.

However, the coupling structure 200 according to Modification Example 3 is configured to realize the coupled state between the rod 21 and the receiving portion 29 and cancel the coupled state depending on the rotational position of the slider 24 from the initial position.

More specifically, the slider 24 in the coupling structure 200 according to Modification Example 3 of Embodiment 2 is the same in configuration as the slider 24 according to Modification Example 1 of Embodiment 2. Therefore, an explanation of the configuration of the slider 24 is omitted.

Figure 36:
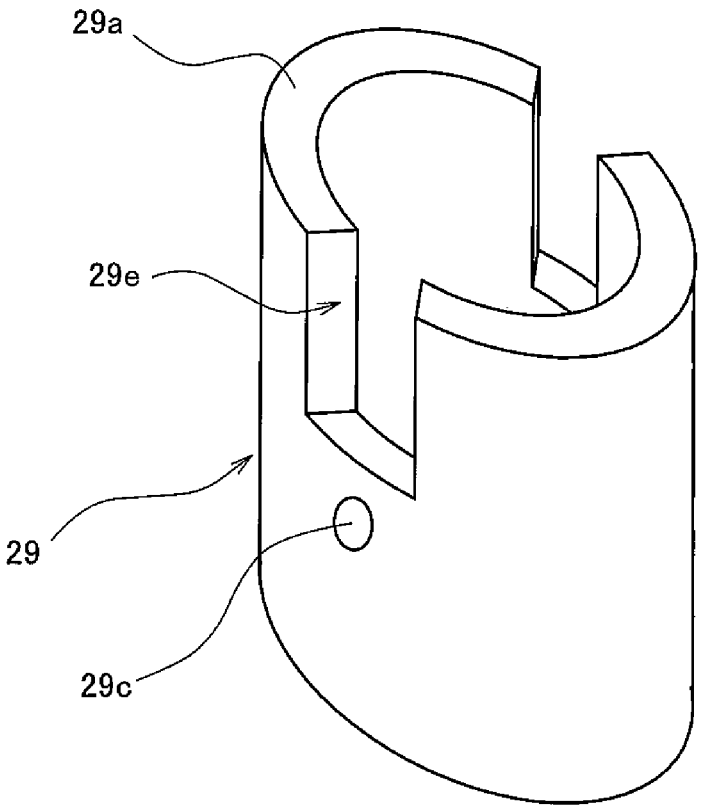
FIG. 36 is a perspective view showing the schematic configuration of the receiving portion included in the coupling structure according to Modification Example 3 of Embodiment 2.

However, the receiving portion 29 according to Modification Example 3 of Embodiment 2 is different in configuration from the receiving portion 29 of the coupling structure 200 according to Modification Example 1 of Embodiment 2. To be specific, as shown in FIG. 36, the receiving portion 29 has a cylindrical shape extending straight from a bottom portion thereof to the insertion-side opening portion 29*a*. Then, a pair of cutout portions 29*e* are respectively formed at opposing positions on the side surface of the receiving portion 29 so as to extend from the insertion-side opening portion 29*a* to the vicinities of the locking pin insertion holes 29*c*. The width of the cutout portion 29*e* is set to be slightly larger than the width of the plate spring 25. FIG. 36 is a perspective view showing the schematic configuration of the receiving portion 29 included in the coupling structure 200 according to Modification Example 3 of Embodiment 2.

Figure 38:
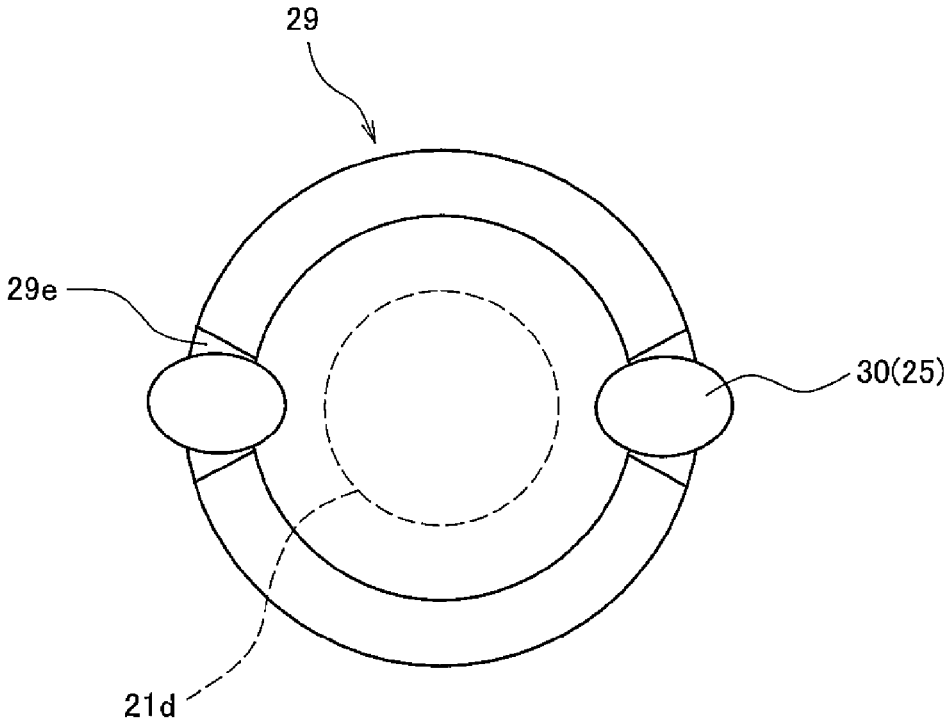
FIG. 38 is a diagram schematically showing a positional relation among the receiving portion, the plate spring contact portion formed at the end portion of the plate spring, and the spherical portion of the rod in the coupling structure according to Modification Example 3 of Embodiment 2.

As described above, the coupling structure 200 according to Embodiment 2 is configured such that while the locking pin 23 moves from the concave portion 24*g*1 of the bottom-side concave-convex portion 24*g* to the concave portion 24*g*2, the locking pin 23 rotates 90° from the initial position. Similarly, the coupling structure 200 according to Modification Example 3 of Embodiment 2 is configured such that while the locking pin 23 moves from the concave portion 24*g*1 to the concave portion 24*g*2, the locking pin 23 rotates 90° from the initial position. When the locking pin 23 is located at the concave portion 24*g*1 of the bottom-side concave-convex portion 24*g*, the pair of plate springs 25 are respectively located at portions where the cutout portions 29*e* are respectively formed, as shown in FIG. 38.

Figure 37:
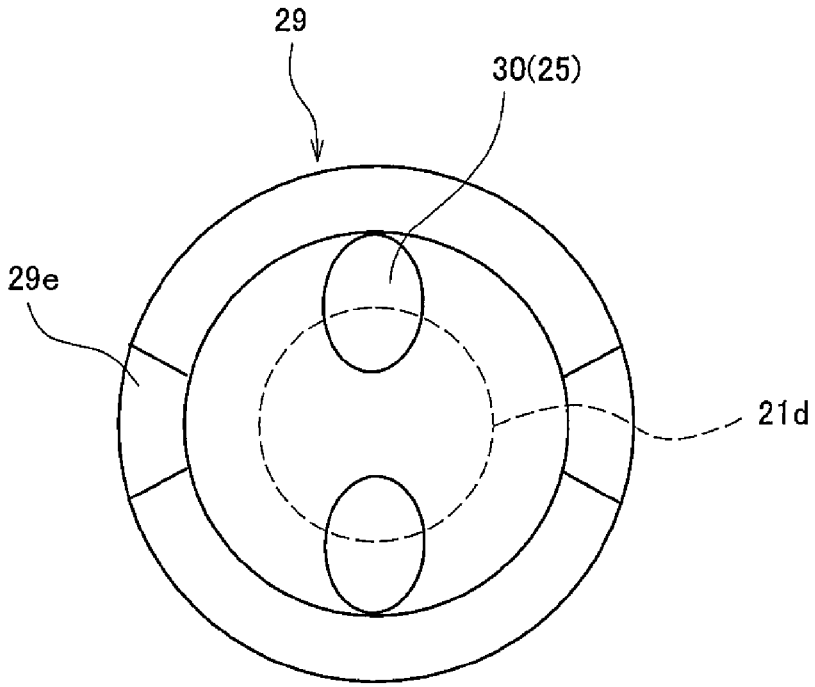
FIG. 37 is a diagram schematically showing a positional relation among the receiving portion, a plate spring contact portion formed at an end portion of the plate spring, and the spherical portion of the rod in the coupling structure according to Modification Example 3 of Embodiment 2.

When the locking pin 23 is located at the concave portion 24*g*1, the pair of plate springs 25 are respectively located at portions where the cutout portions 29*e* are not formed, as shown in FIG. 37. FIGS. 37 and 38 are diagrams each schematically showing a positional relation among the receiving portion 29, the plate spring contact portion 30 formed at the end portion of the plate spring 25, and the spherical portion 21*a* of the rod 21 in the coupling structure 200 according to Modification Example 3 of Embodiment 2.

To be specific, when the locking pin 23 is located at the concave portion 24*g*1, the pair of plate springs 25 are respectively located at the portions where the cutout portions 29*e* are respectively formed. Therefore, the plate springs 25 try to open in a radially outward direction of the slider 24. Then, the plate spring 24 can open outward through the cutout portions 29*e* without being inhibited by the side surface of the receiving portion 29 (see FIG. 38). Therefore, the inner diameter (the inner diameter of the slider 24) of a portion surrounded by the plate springs 25 becomes large, so that the spherical portion 21*a* of the rod 21 can move freely between the plate springs 25. To be specific, when the locking pin 23 is located at the concave portion 24*g*1, the coupling between the rod 21 and the receiving portion 29 can be set to a canceled state.

As shown in FIG. 37, when the locking pin 23 is located at the concave portion 24*g*2, the pair of plate springs 25 are located on the inner peripheral side surface of the receiving portion 29. Therefore, the plate springs 25 that try to open in a radially outward direction of the slider 24 are inhibited by the inner peripheral side surface of the receiving portion 29, and the tip end portions of the plate springs 25 at which the plate spring contact portions 30 are formed face toward the central axis O. On this account, the inner diameter (the inner diameter of the slider 24) of the space surrounded by the plate springs 25 is reduced, and the movement of the spherical portion 21*a* of the rod 21 inserted into the slider 24 is inhibited by the plate spring contact portions 30. To be specific, when the locking pin 23 is located at the concave portion 24*g*2, the coupled state between the rod 21 and the receiving portion 29 can be realized.

In the foregoing, when the locking pin 23 is located at the concave portion 24*g*1 of the bottom-side concave-convex portion 24*g*, the pair of plate springs 25 are respectively located at the portions where the cutout portions 29*e* are respectively formed, as shown in FIG. 38. When the locking pin 23 is located at the concave portion 24*g*2, the pair of plate springs 25 are located on the inner peripheral side surface of the receiving portion 29 as shown in FIG. 37. However, the relation between the position of the locking pin 23 and the arrangement of the plate springs 25 may be reversed.

Modification Example 4

Each of Modification Examples 1 to 3 of Embodiment 2 is configured such that the pair of rod-shaped plate springs 25 respectively having the tip end portions that open outward are joined to the end portion of the insertion-side slide portion 24*a* of the slider 24. However, the present embodiment is not limited to this.

Figure 39:
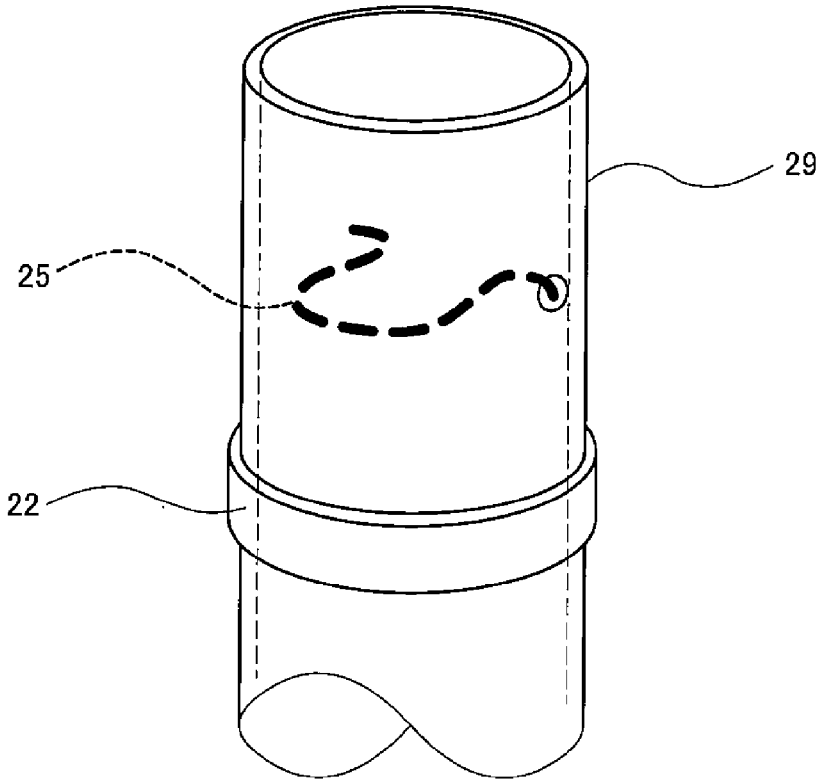
FIG. 39 is a perspective view showing one example of the schematic configuration of the receiving portion included in the coupling structure according to Modification Example 4 of Embodiment 2.

For example, as shown in FIG. 39, the plate spring (coupling unit) 25 having the side surface shape shown in FIG. 24 is joined to an insertion-side inner portion of the receiving portion 29 having a cylindrical shape. FIG. 39 is a perspective view showing one example of the schematic configuration of the receiving portion 29 included in the coupling structure 200 according to Modification Example 4 of Embodiment 2. The plate spring 25 is arranged in the receiving portion 29 such that the side surface thereof is parallel to the cross section taken along the horizontal direction of the receiving portion 29.

Figure 40:
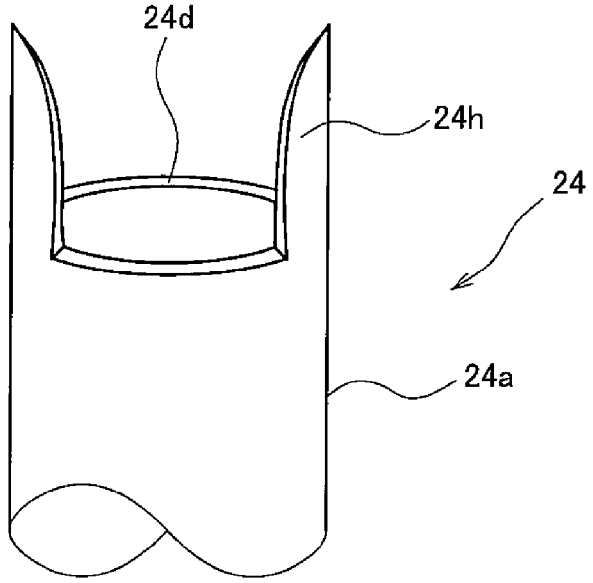
FIG. 40 is a perspective view showing one example of the schematic configuration of the slider included in the coupling structure according to Modification Example 4 of Embodiment 2.

As shown in FIG. 40, a pair of insertion-side projecting portions 24*h* projecting toward the insertion side are formed at the insertion-side end portion of the insertion-side slide portion 24*a* of the slider 24. FIG. 40 is a perspective view showing one example of the schematic configuration of the slider 24 included in the coupling structure 200 according to Modification Example 4 of Embodiment 2. For convenience of explanation, FIG. 40 shows only the vicinity of the insertion-side end portion of the insertion-side slide portion 24*a* of the slider 24, and the other components are omitted. The insertion-side projecting portions 24*h* are rod-shaped members projecting from the outer periphery of the first opening portion 24*d* toward the insertion side, and pointed ends thereof are sharp.

As described above, the coupling structure 200 according to Embodiment 2 is configured such that when the locking pin 23 moves from the concave portion 24*g*1 of the bottom-side concave-convex portion 24*g* to the concave portion 24*g*2, the slider 24 rotates 90° from the initial position in the insertion hole portion 10 and accommodating portion 11 of the receiving portion 9. To be specific, the concave portion 24*g*1 and the concave portion 24*g*2 are respectively formed at positions different from each other in the circumferential direction of the receiving portion 9.

Similarly, the coupling structure 200 according to Modification Example 4 of Embodiment 2 is configured such that the slider 24 rotates in the insertion hole portion 10 and accommodating portion 11 of the receiving portion 9. Then, the plate spring 25 and the slider 24 are arranged such that the positional relation therebetween becomes as below.

Figure 41:
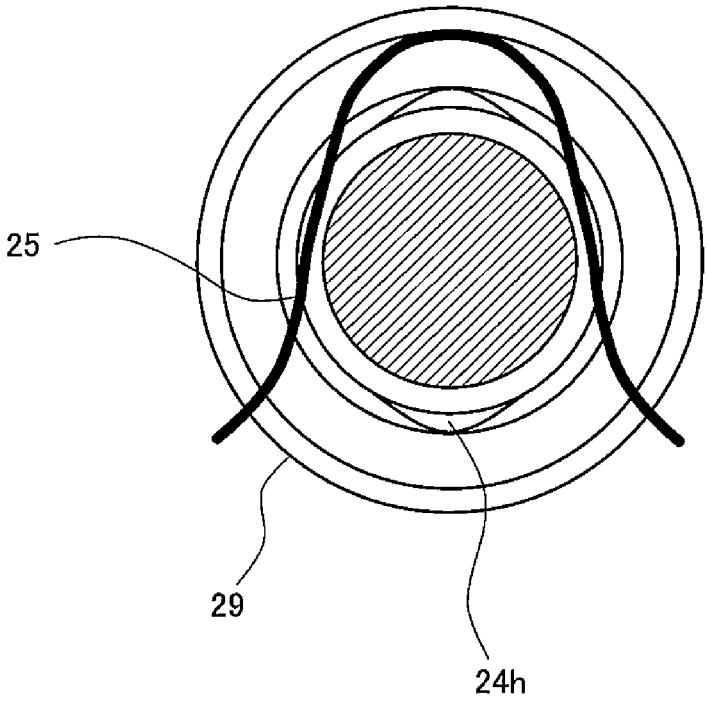
FIG. 41 is a diagram schematically showing one example of a positional relation among the receiving portion, the plate spring, and the spherical portion of the rod in the coupling structure according to Modification Example 4 of Embodiment 2.

To be specific, when the locking pin 23 is located at such a position as to contact the concave portion 24*g*1, the pair of insertion-side projecting portions 24*h* extend close to the plate spring 25, whose side surface shape is a horseshoe shape, to project toward the insertion side as shown in FIG. 41. At this time, in the cross section of the receiving portion 9, the plate spring 25 opens toward the outer periphery of the slider 24 so as not to inhibit the forward and backward movements of the spherical portion 21*a* of the rod 21 in the slider 24 in the insertion direction. Therefore, when the locking pin 23 is located at such a position as to contact the concave portion 24*g*1, the coupling between the rod 21 and the receiving portion 29 can be canceled.

Figure 42:
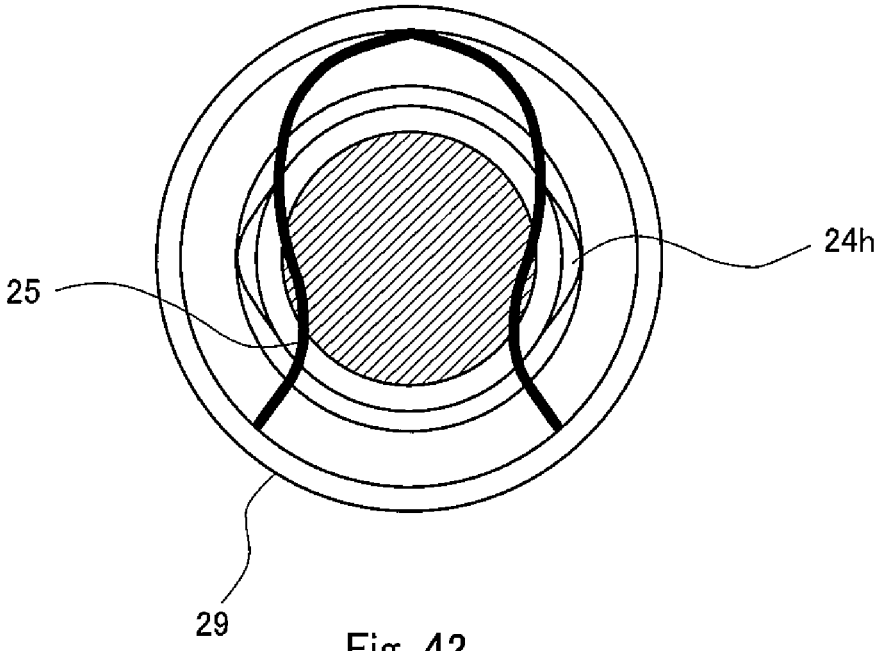
FIG. 42 is a diagram schematically showing one example of a positional relation among the receiving portion, the plate spring, and the spherical portion of the rod in the coupling structure according to Modification Example 4 of Embodiment 2.

When the locking pin 23 is located at such a position as to contact the concave portion 24*g*1, the pair of insertion-side projecting portions 24*h* project so as to sandwich the side portions of the plate spring 25 from outside as shown in FIG. 42. Therefore, the side portions of the plate spring 25 are deformed so as to be bent toward the inside of the slider 24. Since the plate spring 25 is deformed by the insertion-side projecting portions 24*h* as above, in the cross section of the receiving portion 9, the plate spring 25 inhibits the movement of the spherical portion 21*a* of the rod 21 in the slider 24 in a pulling direction. Therefore, when the locking pin 23 is located at such a position as to contact the concave portion 24*g*2, the coupled state between the rod 21 and the receiving portion 29 can be realized.

The foregoing has explained a case where each of the pressing springs 16 and 26 is used as the stretching member of the present invention. However, the stretching member is not limited to these. For example, instead of the pressing spring, a plurality of stretch threads may be provided to extend in a direction substantially perpendicular to the longitudinal direction of the receiving portion 9 or 29.

The accessory coupling structure configured as above may have the following configuration.

In an accessory coupling structure according to the present invention, an inserting portion formed at a first end of the accessory coupling structure is inserted into an insertion hole of a receiving portion formed at a second end of the accessory coupling structure to be fastened to the receiving portion, so that the first end and the second end are integrally coupled to each other. The inserting portion has a rod shape, and an engagement portion is formed at an insertion part of the rod. At least an opening end portion of the insertion hole has such a cross section that allows the rod to move in a radial direction of this opening. A slide portion is formed at a part of the insertion hole. A slider including an insertion hole into which at least the tip end portion of the rod is inserted is provided at the slide portion. The slider is held in the slide portion so as to be slidable in a hole longitudinal direction. The slider includes a coupling unit that can engage with the engagement portion of the rod. A guide unit that guides the coupling unit in a rotational direction and the hole longitudinal direction is provided between an inner peripheral surface of the insertion hole and the slider. Here, when the rod is inserted into the insertion hole to a predetermined depth, the slider moves in accordance with this insertion of the rod. Then, at the time of the movement of the slider, the guide unit guides the coupling unit, and the coupling unit engages with the engagement portion (first position). When the rod is inserted into the insertion hole to a predetermined depth again in a state where the coupling unit engages with the engagement portion of the rod, the slider moves again in accordance with this insertion of the rod. Then, at the time of the movement of the slider, the guide unit guides a locking pin that is the coupling unit, and the engagement portion is released from the coupling unit (second position). Then, the rod can be pulled out from the insertion hole.

In a further specific accessory coupling structure according to the present invention, an inserting portion formed at a first end of the accessory coupling structure is inserted into an insertion hole of a receiving portion formed at a second end of the accessory coupling structure to be fastened to the receiving portion, so that the first end and the second end are integrally coupled to each other. The inserting portion has a straight rod shape having a circular cross section. A locking groove extending in an outer circumferential direction in a ring shape is formed at a tip end portion of the rod. An opening end portion of the insertion hole has such a cross section that allows the rod to move in a radial direction of this opening, and a slide portion is formed at the back of the opening end portion of the insertion hole. A slider is provided at the slide portion, and an insertion hole into which at least the tip end portion of the rod is inserted is formed at a center portion of the slider. The slider is held in the slide portion so as to be slidable in a hole longitudinal direction. The slider is provided with a locking pin that can project or move back in the radial direction of the receiving portion and can engage with the locking groove of the rod. Further, a biasing unit configured to bias the slider toward the opening end of the insertion hole and a guide unit configured to guide the locking pin formed on an inner peripheral surface of the insertion hole are provided. When the rod is inserted into the insertion hole to a predetermined depth, the slider moves in accordance with this insertion of the rod. After that, when hands are released from the rod, the slider moves toward the opening end portion by the biasing unit. At the time of each movement, the guide unit guides the locking pin in the circumferential direction and the hole longitudinal direction to maintain a state where the locking pin projects into the insertion hole. Then, a state where the locking pin engages with the locking groove of the rod (first position) is maintained, and when the rod is inserted into the insertion hole to a predetermined depth again, the slider moves in accordance with this insertion of the rod. Then, when the hands are released from the rod, the slider moves toward the opening end portion by the biasing unit. At the time of each movement, the guide unit guides the locking pin in the circumferential direction and the hole longitudinal direction to cause the locking pin to move from the insertion hole toward the outer diameter side (second position). Then, the rod can be pulled out from the insertion hole.

According to the accessory coupling structure of the present invention configured as above, the rod at the first end is easily coupled to the insertion hole portion at the second end only by inserting the rod into the insertion hole to a predetermined depth (such a depth that the locking groove (engagement portion) of the rod passes through the locking pin (coupling unit) of the slider), the insertion hole having such a hole diameter that the rod can move. To be specific, the rod is inserted into the insertion hole against the biasing force of the biasing unit to insert the slider to the predetermined depth, and the hands are released from the rod. By this movement and the subsequent movement by the biasing of the biasing unit, the locking pin provided at the slider is guided by the guide unit in the circumferential direction and the hole longitudinal direction. Thus, the slider is located at the first position. At this position, the locking pin is pressed toward the insertion hole by the guide unit, and the end portion of the locking pin engages with the locking groove of the tip end portion of the rod. As a result, in the accessory coupling structure according to the present invention, the rod and the slider are surely coupled to each other via the locking pin. Then, the tip end portion of the rod can engage with the inside of the insertion hole, and this state can be maintained.

Since the rod has a straight shape and a circular cross section, the base end portion or the like of the rod can be held by two fingers (such as a thumb and a forefinger) of one of hands, and the rod can be easily inserted into the insertion hole of the insertion hole portion held by the other hand without positioning in the rotational direction. In addition, in a state where the rod is being inserted into the insertion hole, the rod can move in the insertion hole in the radial direction of the insertion hole that is perpendicular to the longitudinal direction of the rod. Therefore, the accessory coupling structure according to the present invention can realize the coupling in a state where the accessory coupling structure is bent along the curved line of a neck or arm. Since the opening end portion of the insertion hole has such a size that allows the rod to move in the radial direction, the rod can be easily inserted into the insertion hole.

When canceling the coupling between the rod and the insertion hole portion, the rod is again pushed into the insertion hole against the biasing force of the biasing unit by a predetermined depth in the coupled state. By pushing the rod as above, the guide unit guides the locking pin to the second position, and the locking pin moves toward the outer diameter side of the slider. Thus, the locking pin gets out of the locking groove of the rod. As a result, the coupling between the rod and the slider is canceled, and the rod can be freely pulled out from the insertion hole portion.

The insertion hole portion including the guide unit having a comparatively complex shape formed on the inner peripheral surface of the insertion hole in the accessory coupling structure can be easily manufactured by casting. Regarding the rod, the ring-shaped groove is just formed on the tip end portion of the rod. Therefore, the entire accessory coupling structure according to the present invention can be easily manufactured. Regarding the assembly, the slider at which the locking pin is provided is just inserted into the insertion hole and arranged so as to be biased by the biasing unit toward the opening end side of the insertion hole. Therefore, the accessory coupling structure can be easily assembled.

In the accessory coupling structure, the guide unit is constituted by the guide groove formed on the inner peripheral surface of the insertion hole. Then, the width of the guide groove in the hole longitudinal direction of the insertion hole is set such that the locking pin can move in the hole longitudinal direction. Further, the guide groove is formed in a zigzag manner in the circumferential direction of the insertion hole. Therefore, each time the rod is inserted into the insertion hole portion or each time the rod is released, the locking pin and the slider rotate by a predetermined angle in the insertion hole of the receiving portion, and the slider can be alternately guided to the first position and the second position. By forming the shape of the guide groove on a die, the insertion hole portion including the guide groove can be easily manufactured by casting at low cost.

In a case where a plurality of locking pins are arranged on the side peripheral wall of the slider so as to form a pair relative to the center of the insertion hole or be provided at regular intervals, the coupling structure in which the guide unit guides the locking pins more smoothly and stably can be realized. For example, in a case where three locking pins are arranged on the side peripheral wall of the slider at angular intervals of 120°, external force acts uniformly, so that the slider is guided smoothly and stably.

As shown in FIG. 12, a large-diameter portion (head portion) may be formed at an outer peripheral end portion of the locking pin. Or, the movement of the locking pin into the insertion hole may be restricted in such a manner that: the large-diameter portion is formed at the outer peripheral end portion of the locking pin; and the locking pin insertion hole into which the locking pin is inserted is formed in a tapered shape toward the inner diameter side as shown in FIG. 13. With this, the locking pin can be prevented from falling in the insertion hole.

In a case where the accessory according to the present invention is a necklace or a bracelet, the coupling can be easily realized and canceled even at a position, such as the back side of a neck or the rear side of an aim, which is out of sight.

Each of Embodiments 1 and 2 of the present invention has explained an example in which the accessory is the necklace. However, the present invention is also applicable to coupling structures of the other accessories, such as bracelets, anklets, chain belts, and pierce catches.

Embodiments 1 and 2, Modification Examples 1 to 5 of Embodiment 1, and Modification Example 1 to 4 of Embodiment 2 are just examples, and the present invention is not limited to these examples. Needless to say, various modifications may be made within the technical idea of the present invention.

INDUSTRIAL APPLICABILITY

The accessory coupling structure according to the present invention is widely utilized as the coupling structure of the accessory.

REFERENCE SIGNS LIST

A necklace (accessory)
Ea first end
Eb second end
1 rod (inserting portion)
1*a* locking groove (engagement portion)
9 receiving portion
10 insertion hole portion (insertion hole)
10*c* guide groove (guide unit)
11 accommodating portion (insertion hole)
13 locking pin (coupling unit)
14 slider
16 pressing spring (stretching member)
21 rod (inserting portion)
21*a* spherical portion (engagement portion)
23 locking pin
24 slider
25 plate spring (coupling unit)
26 pressing spring (stretching member)
29 receiving portion

The invention claimed is:

1. An accessory coupling structure comprising:
a rod-shaped inserting portion attached to a first end of an accessory; and
a receiving portion attached to a second end of the accessory and including an insertion hole that receives the inserting portion, wherein
the receiving portion includes:
a cylindrical slider into which at least a tip end portion of the inserting portion is inserted and which is slidable and rotatable in the insertion hole;
a guide unit configured to restrict a movement of the slider in the insertion hole such that the slider is rotated relative to the insertion hole in response to insertion of the inserting portion, and a position of the slider is therefore switched to a first position or a second position; and
a coupling unit configured to,
when the slider is located at the first position, inhibit a movement of the inserting portion in the receiving portion in a pull-out direction, and
when the slider is located at the second position, allow the inserting portion to move in an insertion direction and the pull-out direction in the receiving portion.

2. The accessory coupling structure according to claim 1, wherein the inserting portion includes an engagement portion that engages with the coupling unit of the receiving portion when the slider is located at the first position.

3. The accessory coupling structure according to claim 2, wherein:
the receiving portion includes a stretching member that presses the slider in a direction opposite to the insertion direction of the inserting portion; and
the guide unit switches the position of the slider in the insertion hole to the first position or the second position in accordance with the movement of the slider in the insertion direction by insertion of the inserting portion and the movement of the slider in a pressing direction by pressing of the stretching member.

4. The accessory coupling structure according to claim 3, wherein:
the guide unit is a guide groove which is formed on an inner peripheral surface of the receiving portion in a circumferential direction of the receiving portion and has a periodical concave-convex shape, the inner peripheral surface forming the insertion hole;
the slider includes a plurality of locking pins which move along the guide groove and respectively engage with concave portions of the guide groove when the slider is located at the first position or the second position; and
each of the concave portions with which the locking pins respectively engage when the slider is located at the first position and each of the concave portions with which the locking pins respectively engage when the slider is located at the second position are respectively formed at positions different from each other in the insertion direction of the inserting portion.

5. The accessory coupling structure according to claim 3, wherein:
the guide unit is a concave-convex portion formed in a circumferential direction of the slider and having a periodical concave-convex shape;
the receiving portion includes a locking pin formed in the insertion hole of the receiving portion so as to project toward the slider;
the slider rotates while the concave-convex portion and the locking pin contact each other, and when the slider is located at the first position or the second position, the locking pin engages with one of concave portions of the concave-convex portion; and
the concave portion with which the locking pin engages when the slider is located at the first position and the concave portion with which the locking pin engages when the slider is located at the second position are respectively formed at positions different from each other in the insertion direction of the inserting portion.

6. The accessory coupling structure according to claim 3, wherein:
the guide unit is a concave-convex portion formed in a circumferential direction of the slider and having a periodical concave-convex shape;
the receiving portion includes a locking pin formed in the insertion hole of the receiving portion so as to project toward the slider;
the slider rotates while the concave-convex portion and the locking pin contact each other, and when the slider is located at the first position or the second position, the locking pin engages with one of concave portions of the concave-convex portion; and
the concave portion with which the locking pin engages when the slider is located at the first position and the concave portion with which the locking pin engages when the slider is located at the second position are respectively formed at positions different from each other in a circumferential direction of the receiving portion.

7. The accessory coupling structure according to claim 4, wherein:
the locking pins are movable in a direction perpendicular to the insertion direction of the inserting portion and toward an inside of the slider into which the inserting portion is inserted;
the inner peripheral surface of the receiving portion on which the concave portions, with which the locking pins respectively engage when the slider is located at the first position, of the guide groove are formed tapers in a pull-out direction of the inserting portion; and the plurality of locking pins that engage with the guide groove as the coupling unit contact the inner peripheral surface of the receiving portion and move toward the inside of the slider to inhibit the movement of the inserting portion in the pull-out direction.

8. The accessory coupling structure according to claim 5, wherein the slider includes as the coupling unit a plate spring which contacts at least a part of an inner peripheral surface of the slider when the slider is located at the first position, to deform to inhibit the movement of the inserting portion in the slider in the pull-out direction.

9. The accessory coupling structure according to claim 6, wherein the receiving portion includes as the coupling unit a plate spring which contacts at least a part of an inner peripheral surface of the slider when the slider is located at the first position, to deform to inhibit the movement of the inserting portion in the insertion hole in the pull-out direction.

* * * * *